US009500966B2

(12) United States Patent
Watariguchi et al.

(10) Patent No.: US 9,500,966 B2
(45) Date of Patent: Nov. 22, 2016

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Kaname Watariguchi, Yokohama (JP); Masato Tanaka, Tagata-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/480,623

(22) Filed: Sep. 8, 2014

(65) Prior Publication Data

US 2015/0093694 A1 Apr. 2, 2015

(30) Foreign Application Priority Data

Sep. 30, 2013 (JP) ..... 2013-204613

(51) Int. Cl.
*G03G 5/06* (2006.01)
*G03G 5/05* (2006.01)

(52) U.S. Cl.
CPC ..... *G03G 5/0696* (2013.01); *G03G 5/0521* (2013.01); *G03G 5/0542* (2013.01); *G03G 5/0589* (2013.01); *G03G 5/0612* (2013.01); *G03G 5/0624* (2013.01)

(58) Field of Classification Search
CPC . G03G 5/0614; G03G 5/0631; G03G 5/0696
See application file for complete search history.

(56) References Cited

U.S. PATENT DOCUMENTS 8,088,541 B2 1/2012 Tanaka et al.
8,415,078 B2 4/2013 Tanaka et al.
2009/0123176 A1* 5/2009 Tanaka ..... C08F 8/32 399/111
2012/0003576 A1* 1/2012 Tanaka ..... G03G 5/0614 430/56
2013/0137032 A1 5/2013 Tanaka et al.
2014/0170540 A1* 6/2014 Tanaka ..... G03G 5/0542 430/56
2014/0170541 A1 6/2014 Tanaka

FOREIGN PATENT DOCUMENTS

JP 2007-182556 A 7/2007
JP 2012-32781 A 2/2012
WO 2013/081178 A1 6/2013

* cited by examiner

*Primary Examiner* — Hoa V Le
(74) *Attorney, Agent, or Firm* — Fitzpatrick, Cella, Harper & Scinto

(57) ABSTRACT

An electrophotographic photosensitive member, comprising a support, a charge generating layer on the support and a charge transporting layer on the charge generating layer, wherein the charge generating layer comprises a gallium phthalocyanine crystal, a nitrogen-containing heterocyclic compound and a compound represented by Formula (1), wherein a nitrogen atom in a heterocyclic ring of the nitrogen-containing heterocyclic compound has a substituent.

Formula (1)

20 Claims, 3 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus including an electrophotographic photosensitive member.

Description of the Related Art

Image exposing units in the electrophotographic field often use semiconductor lasers having a long emission wavelength of 650 to 820 nm, and electrophotographic photosensitive members highly sensitive to light at the long wavelength have been currently developed. Also, electrophotographic photosensitive members highly sensitive to light emitted from semiconductor lasers having a short emission wavelength have been recently developed for high resolution.

Phthalocyanine pigments used as a material for the electrophotographic photosensitive member are known as a charge generating substance highly sensitive to light from the long wavelength range to the short wavelength range. In particular, oxytitanium phthalocyanine and gallium phthalocyanine have high sensitivity, and a variety of crystal forms thereof have been reported.

Unfortunately, the electrophotographic photosensitive member containing the gallium phthalocyanine pigment generates a large amount of photocarriers (pairs of holes and electrons), and the electrons corresponding the holes moved by a hole transport substance readily stagnate in a photosensitive layer (charge generating layer). Because of this, a problem of the electrophotographic photosensitive member containing a gallium phthalocyanine pigment often is to likely cause a phenomenon called ghost. Specifically, this phenomenon appears as positive ghost in which an output image has a high density in only portions irradiated during the previous rotation or negative ghost in which an output image has a low density in only portions irradiated during the previous rotation.

The electrophotographic photosensitive member containing a gallium phthalocyanine pigment has high sensitivity while its dispersibility of pigment particles may be insufficient. This likely leads to a reduction in electrophotographic properties, which is a further problem.

Japanese Patent Application Laid-Open No. 2012-32781 reports that ghost can be improved by adding a specific amine compound to a charge generating layer.

Japanese Patent Application Laid-Open No. 2007-182556 reports that use of a resin for a charge generating layer having a specific triphenylamine skeleton can improve dispersibility and photosensitivity.

Ghost suppression is currently desired under a variety of environments. Among these, ghost readily occurs in a low temperature and low humidity environment in particular. The present inventors, who have conducted extensive research, found that the techniques described in Japanese Patent Application Laid-Open No. 2012-32781 and Japanese Patent Application Laid-Open No. 2007-182556 may not attain a sufficient ghost-suppressing effect under such a low temperature and low humidity environment.

SUMMARY OF THE INVENTION

The present invention is directed to providing an electrophotographic photosensitive member that provides ghost suppression even under a low temperature and low humidity environment.

Further, the present invention is directed to providing an electrophotographic apparatus and a process cartridge including the electrophotographic photosensitive member.

According to one aspect of the present invention, there is provided an electrophotographic photosensitive member comprising a support; a charge generating layer on the support; and a charge transporting layer on the charge generating layer, wherein the charge generating layer includes: a gallium phthalocyanine crystal; a nitrogen-containing heterocyclic compound; and a resin having a structural unit represented by Formula (1):

Formula (1)

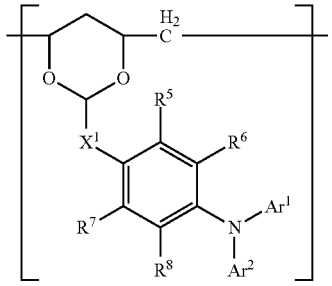

wherein $X^1$ represents a substituted or unsubstituted ethylene group, a substituted or unsubstituted propylene group, or a substituted or unsubstituted butylene group; $R^5$, $R^6$, $R^7$ and $R^8$ each independently represent a hydrogen atom, a saturated hydrocarbon group or a methoxy group; and $Ar^1$ and $Ar^2$ each independently represent a phenyl group having one or more electron-donating substituents; and wherein a nitrogen atom in a heterocyclic ring of the nitrogen-containing heterocyclic compound has a substituent, wherein the substituent is a substituted or unsubstituted acyl group, —(C═O)—O—$R^1$, a substituted or unsubstituted alkyl group, a substituted or unsubstituted alkenyl group, a substituted or unsubstituted aryl group, or a substituted or unsubstituted heterocyclic group, wherein a substituent of the substituted acyl group is a substituted or unsubstituted alkyl group, a substituted or unsubstituted alkenyl group, a substituted or unsubstituted aryl group, or a substituted or unsubstituted heterocyclic group; $R^1$ represents a substituted or unsubstituted alkyl group, a substituted or unsubstituted alkenyl group, a substituted or unsubstituted aryl group, or a substituted or unsubstituted heterocyclic group; and a substituent of the substituted alkyl group, a substituent of the substituted alkenyl group, a substituent of the substituted aryl group and a substituent of the substituted heterocyclic group are a halogen atom, a cyano group, a nitro group, a hydroxy group, a formyl group, an alkyl group, an alkenyl group, an alkoxy group or an aryl group.

According to another aspect of the present invention, there is provided a process cartridge detachably mountable on a main body of an electrophotographic apparatus, the process cartridge including the electrophotographic photosensitive member, and at least one unit selected from the group consisting of a charging unit, a developing unit, a transferring unit and a cleaning unit, the electrophotographic photosensitive member and the at least one unit being integrally supported.

According to further aspect of the present invention, there is provided an electrophotographic apparatus including the electrophotographic photosensitive member, a charging unit, an image exposing unit, a developing unit, and a transferring unit.

The present invention can provide an electrophotographic photosensitive member that provides ghost suppression even under a low temperature and low humidity environment, and a process cartridge and an electrophotographic apparatus including the electrophotographic photosensitive member.

Further features of the present invention will become apparent from the following description of exemplary embodiments with reference to the attached drawings.

DESCRIPTION OF THE EMBODIMENTS

Figure 1:
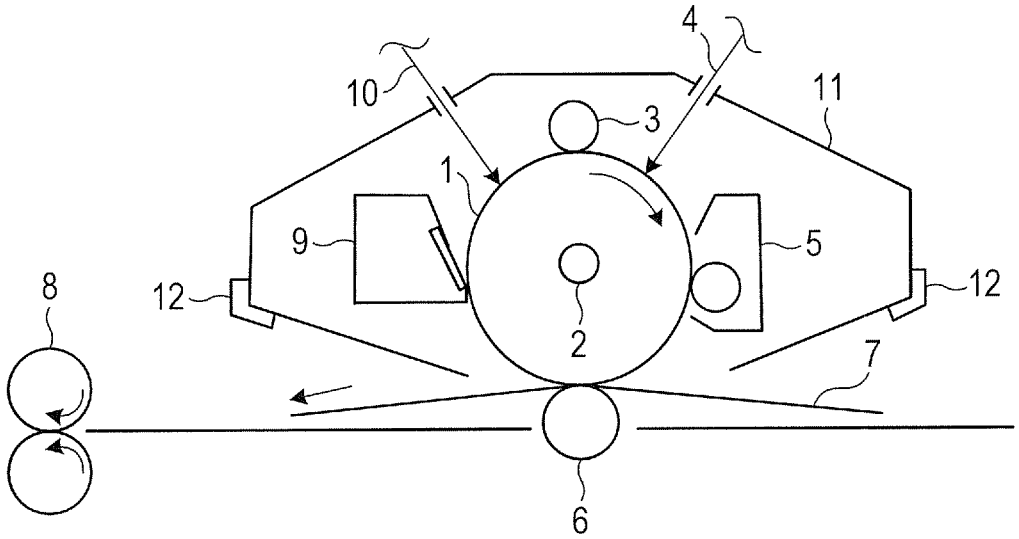
FIG. 1 is a drawing illustrating an example of a schematic configuration of an electrophotographic apparatus including a process cartridge including an electrophotographic photosensitive member according to the present invention.

Preferred embodiments of the present invention will now be described in detail in accordance with the accompanying drawings.

The electrophotographic photosensitive member according to the present invention is an electrophotographic photosensitive member including a support; a charge generating layer on the support; and a charge transporting layer on the charge generating layer, wherein the charge generating layer includes: a gallium phthalocyanine crystal; a nitrogen-containing heterocyclic compound; and a resin having a structural unit represented by Formula (1):

Formula (1)

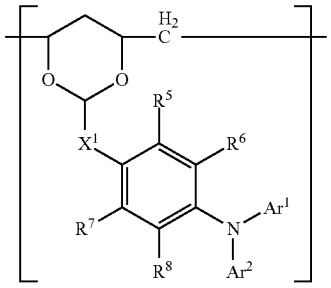

wherein $X^1$ represents a substituted or unsubstituted ethylene group, a substituted or unsubstituted propylene group, or a substituted or unsubstituted butylene group; $R^5$, $R^6$, $R^7$ and $R^8$ each independently represent a hydrogen atom, a saturated hydrocarbon group or a methoxy group; and $Ar^1$ and $Ar^2$ each independently represent a phenyl group having one or more electron-donating substituents, a nitrogen atom in a heterocyclic ring of the nitrogen-containing heterocyclic compound has a substituent, wherein the substituent is a substituted or unsubstituted acyl group, —(C═O)—O—$R^1$, a substituted or unsubstituted alkyl group, a substituted or unsubstituted alkenyl group, a substituted or unsubstituted aryl group, or a substituted or unsubstituted heterocyclic group, wherein a substituent of the substituted acyl group is a substituted or unsubstituted alkyl group, a substituted or unsubstituted alkenyl group, a substituted or unsubstituted aryl group, or a substituted or unsubstituted heterocyclic group; $R^1$ represents a substituted or unsubstituted alkyl group, a substituted or unsubstituted alkenyl group, a substituted or unsubstituted aryl group, or a substituted or unsubstituted heterocyclic group; and a substituent of the substituted alkyl group, a substituent of the substituted alkenyl group, a substituent of the substituted aryl group and a substituent of the substituted heterocyclic group are a halogen atom, a cyano group, a nitro group, a hydroxy group, a formyl group, an alkyl group, an alkenyl group, an alkoxy group or an aryl group.

The nitrogen-containing heterocyclic compound can be pyrrole, pyrrolidine, morpholine, piperazine, piperidine, 4-piperidone, indole, phenothiazine, phenoxazine or carbazole. Among these, morpholine, piperazine, piperidine, 4-piperidone and indole are more preferable.

Examples of the substituent bonding to an atom other than a nitrogen atom (such as a carbon atom) forming the ring of the nitrogen-containing heterocyclic compound include the followings. Namely, a hydrogen atom, a substituted or unsubstituted alkyl group, a substituted or unsubstituted aryl group, a substituted or unsubstituted heterocyclic group, a halogen atom, a hydroxy group, a formyl group, an alkenyl group, an alkoxy group or an alkyloxycarbonyl group can be used.

At this time, a substituent of the substituted alkyl group, a substituent of the substituted aryl group and a substituent of the substituted heterocyclic group are more preferably a halogen atom, a hydroxy group or a formyl group.

From the viewpoint of ghost-suppressing effect under a low temperature and low humidity environment, particularly preferable nitrogen-containing heterocyclic compounds are compounds represented by Formulae (2) to (6):

Formula (2)

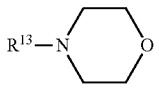

wherein $R^{13}$ represents a substituted or unsubstituted acyl group, —(C═O)—O—$R^{11}$, a substituted or unsubstituted alkyl group, a substituted or unsubstituted alkenyl group, a substituted or unsubstituted aryl group, or a substituted or unsubstituted heterocyclic group; a substituent of the substituted acyl group is a substituted or unsubstituted alkyl group, a substituted or unsubstituted alkenyl group, a substituted or unsubstituted aryl group, or a substituted or unsubstituted heterocyclic group; $R^{11}$ represents a substituted or unsubstituted alkyl group, a substituted or unsubstituted alkenyl group, a substituted or unsubstituted aryl group, or a substituted or unsubstituted heterocyclic group.

A substituent of the substituted alkyl group, a substituent of the substituted alkenyl group, a substituent of the substituted aryl group and a substituent of the substituted heterocyclic group are more preferably a halogen atom, a cyano group, a nitro group, a hydroxy group, a formyl group, an alkyl group, an alkenyl group, an alkoxy group or an aryl group.

Formula (3)

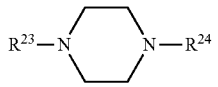

wherein $R^{23}$ and $R^{24}$ each independently represent a substituted or unsubstituted acyl group, —(C═O)—O—$R^{21}$, a substituted or unsubstituted alkyl group, a substituted or unsubstituted alkenyl group, a substituted or unsubstituted aryl group, or a substituted or unsubstituted heterocyclic group; a substituent of the substituted acyl group is a substituted or unsubstituted alkyl group, a substituted or unsubstituted alkenyl group, a substituted or unsubstituted aryl group, or a substituted or unsubstituted heterocyclic group; $R^{21}$ represents a substituted or unsubstituted alkyl group, a substituted or unsubstituted alkenyl group, a substituted or unsubstituted aryl group, or a substituted or unsubstituted heterocyclic group.

A substituent of the substituted alkyl group, a substituent of the substituted alkenyl group, a substituent of the substituted aryl group and a substituent of the substituted heterocyclic group are more preferably a halogen atom, a cyano group, a nitro group, a hydroxy group, a formyl group, an alkyl group, an alkenyl group, an alkoxy group or an aryl group.

Formula (4)

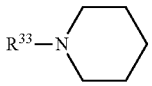

wherein $R^{33}$ represents a substituted or unsubstituted acyl group, —(C═O)—O—$R^{31}$, a substituted or unsubstituted alkyl group, a substituted or unsubstituted alkenyl group, a substituted or unsubstituted aryl group, or a substituted or unsubstituted heterocyclic group; a substituent of the substituted acyl group is a substituted or unsubstituted alkyl group, a substituted or unsubstituted alkenyl group, a substituted or unsubstituted aryl group, or a substituted or unsubstituted heterocyclic group; and $R^{31}$ represents a substituted or unsubstituted alkyl group, a substituted or unsubstituted alkenyl group, a substituted or unsubstituted aryl group, or a substituted or unsubstituted heterocyclic group.

A substituent of the substituted alkyl group, a substituent of the substituted alkenyl group, a substituent of the substituted aryl group and a substituent of the substituted heterocyclic group are more preferably a halogen atom, a cyano group, a nitro group, a hydroxy group, a formyl group, an alkyl group, an alkenyl group, an alkoxy group or an aryl group.

Formula (5)

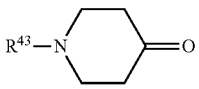

wherein $R^{43}$ represents a substituted or unsubstituted acyl group, —(C═O)—O—$R^{41}$, a substituted or unsubstituted alkyl group, a substituted or unsubstituted alkenyl group, a substituted or unsubstituted aryl group, or a substituted or unsubstituted heterocyclic group; a substituent of the substituted acyl group is a substituted or unsubstituted alkyl group, a substituted or unsubstituted alkenyl group, a substituted or unsubstituted aryl group, or a substituted or unsubstituted heterocyclic group; and $R^{41}$ represents a substituted or unsubstituted alkyl group, a substituted or unsubstituted alkenyl group, a substituted or unsubstituted aryl group, or a substituted or unsubstituted heterocyclic group.

A substituent of the substituted alkyl group, a substituent of the substituted alkenyl group, a substituent of the substituted aryl group and a substituent of the substituted heterocyclic group are more preferably a halogen atom, a cyano group, a nitro group, a hydroxy group, a formyl group, an alkyl group, an alkenyl group, an alkoxy group or an aryl group.

Formula (6)

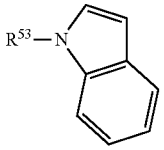

wherein $R^{53}$ represents a substituted or unsubstituted acyl group, —(C═O)—O—$R^{51}$, a substituted or unsubstituted alkyl group, a substituted or unsubstituted alkenyl group, a substituted or unsubstituted aryl group, or a substituted or unsubstituted heterocyclic group; a substituent of the substituted acyl group is a substituted or unsubstituted alkyl group, a substituted or unsubstituted alkenyl group, a substituted or unsubstituted aryl group, or a substituted or unsubstituted heterocyclic group; $R^{51}$ represents a substituted or unsubstituted alkyl group, a substituted or unsubstituted alkenyl group, a substituted or unsubstituted aryl group, or a substituted or unsubstituted heterocyclic group.

A substituent of the substituted alkyl group, a substituent of the substituted alkenyl group, a substituent of the substituted aryl group and a substituent of the substituted heterocyclic group are more preferably a halogen atom, a cyano group, a nitro group, a hydroxy group, a formyl group, an alkyl group, an alkenyl group, an alkoxy group or an aryl group.

In Formulae (2) to (6), $R^{13}$, $R^{23}$, $R^{24}$, $R^{33}$, $R^{43}$ and $R^{53}$ can each independently represent a methyl group, an ethyl group or a phenyl group.

The content of the nitrogen-containing heterocyclic compound in the charge generating layer can be 0.01% by mass or more and 20% by mass or less based on the gallium phthalocyanine crystal.

The gallium phthalocyanine crystal can be a gallium phthalocyanine crystal in which the nitrogen-containing heterocyclic compound is contained.

Now, preferable specific examples (Exemplary compounds which is abbreviated to "Exemplary Cpd" hereinafter) of the nitrogen-containing heterocyclic compound contained in the electrophotographic photosensitive member according to the present invention will be shown, but the present invention will not be limited to these.

Exemplary Cpd (1)

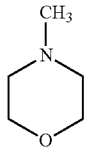

Exemplary Cpd (2)

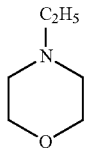

Exemplary Cpd (3)

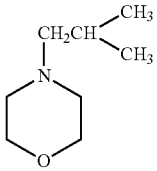

Exemplary Cpd (4)

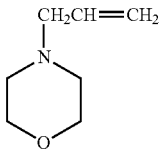

Exemplary Cpd (5)

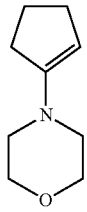

Exemplary Cpd (6)

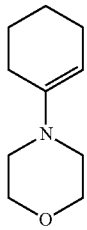

Exemplary Cpd (7)

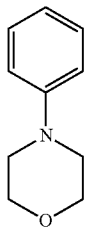

-continued

Exemplary Cpd (8)

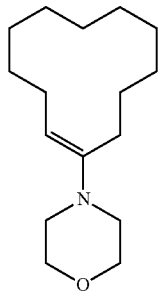

Exemplary Cpd (9)

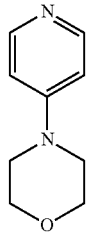

Exemplary Cpd (10)

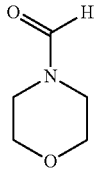

Exemplary Cpd (11)

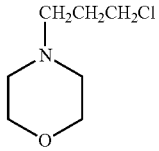

Exemplary Cpd (12)

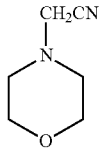

Exemplary Cpd (13)

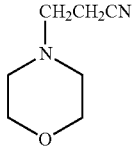

Exemplary Cpd (14)

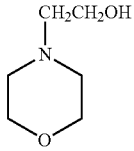

Exemplary Cpd (15)

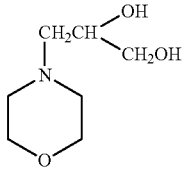

-continued
Exemplary Cpd (16)
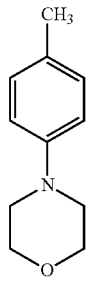
Exemplary Cpd (17)
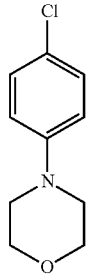
Exemplary Cpd (18)
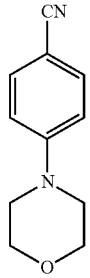
Exemplary Cpd (19)
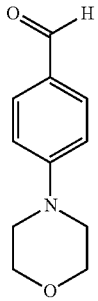
Exemplary Cpd (20)
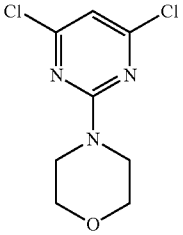
Exemplary Cpd (21)
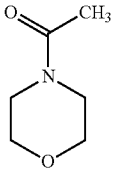
-continued
Exemplary Cpd (22)
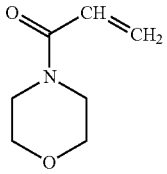
Exemplary Cpd (23)
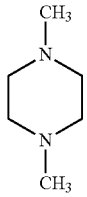
Exemplary Cpd (24)
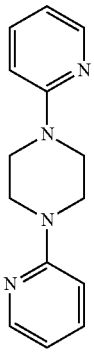
Exemplary Cpd (25)
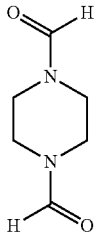
Exemplary Cpd (26)
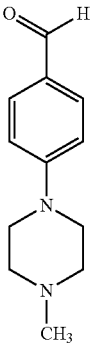

-continued
Exemplary Cpd (27)
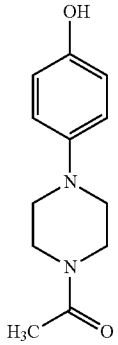
Exemplary Cpd (28)
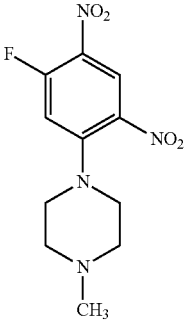
Exemplary Cpd (29)
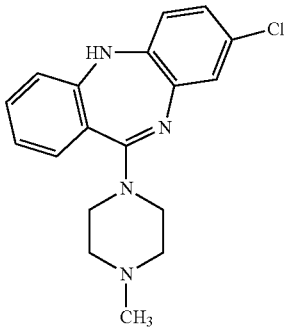
Exemplary Cpd (30)
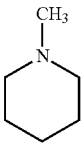
Exemplary Cpd (31)
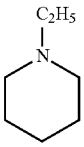
Exemplary Cpd (32)
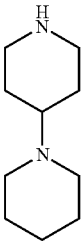
-continued
Exemplary Cpd (33)
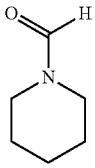
Exemplary Cpd (34)
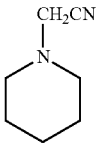
Exemplary Cpd (35)
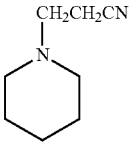
Exemplary Cpd (36)
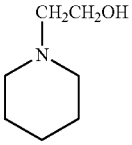
Exemplary Cpd (37)
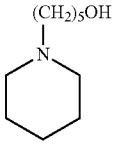
Exemplary Cpd (38)
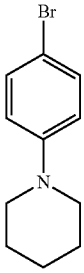
Exemplary Cpd (39)
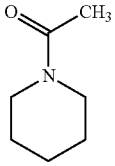
Exemplary Cpd (40)
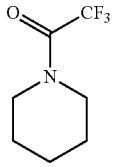
Exemplary Cpd (41)
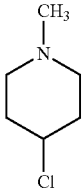

-continued
Exemplary Cpd (42)
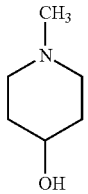
Exemplary Cpd (43)
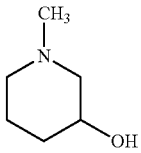
Exemplary Cpd (44)
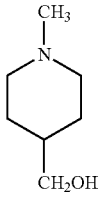
Exemplary Cpd (45)
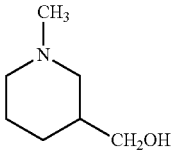
Exemplary Cpd (46)
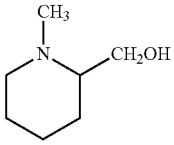
Exemplary Cpd (47)
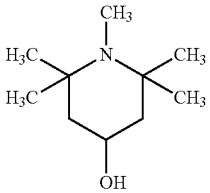
Exemplary Cpd (48)
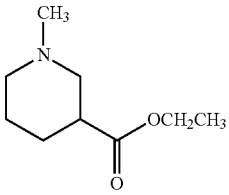
Exemplary Cpd (49)
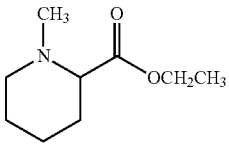
Exemplary Cpd (50)
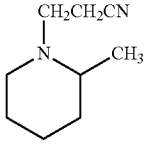
-continued
Exemplary Cpd (51)
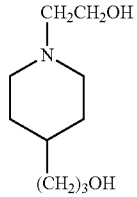
Exemplary Cpd (52)
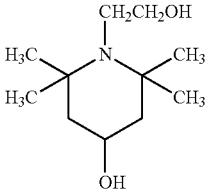
Exemplary Cpd (53)
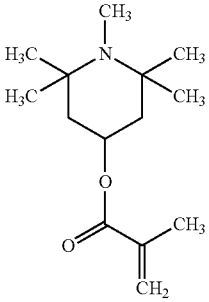
Exemplary Cpd (54)
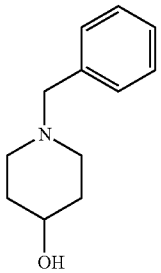
Exemplary Cpd (55)
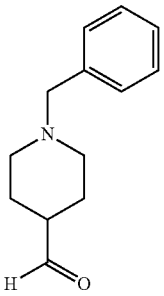
Exemplary Cpd (56)
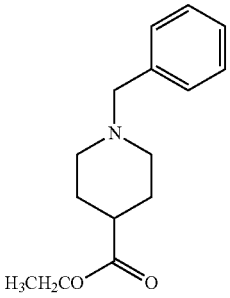

-continued
Exemplary Cpd (57)
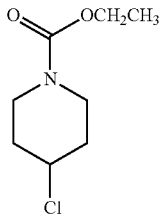
Exemplary Cpd (58)
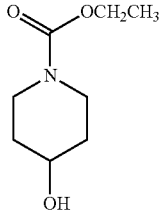
Exemplary Cpd (59)
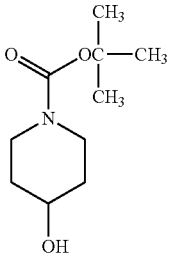
Exemplary Cpd (60)
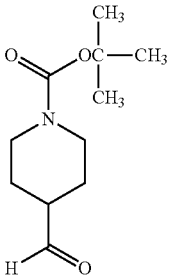
Exemplary Cpd (61)
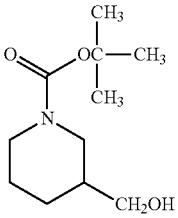
Exemplary Cpd (62)
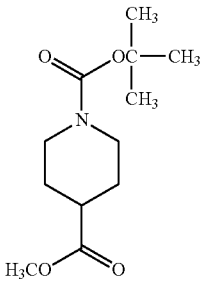
-continued
Exemplary Cpd (63)
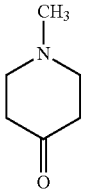
Exemplary Cpd (64)
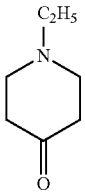
Exemplary Cpd (65)
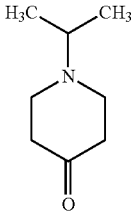
Exemplary Cpd (66)
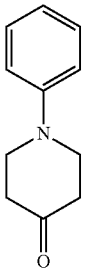
Exemplary Cpd (67)
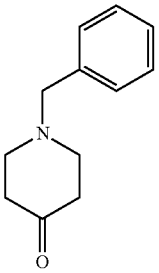
Exemplary Cpd (68)
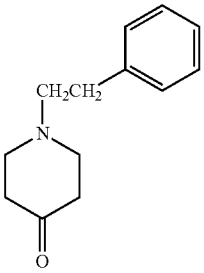

-continued
Exemplary Cpd (69)
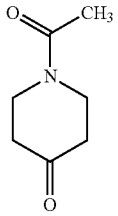
Exemplary Cpd (70)
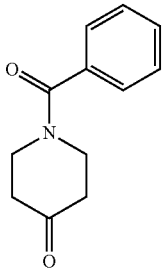
Exemplary Cpd (71)
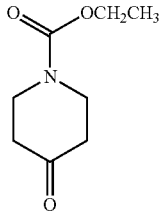
Exemplary Cpd (72)
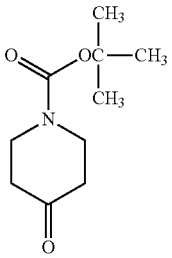
Exemplary Cpd (73)
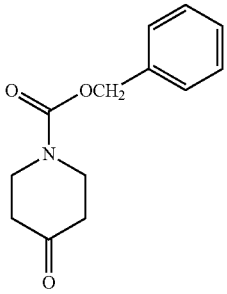
Exemplary Cpd (74)
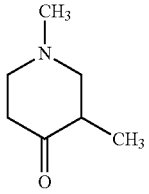
-continued
Exemplary Cpd (75)
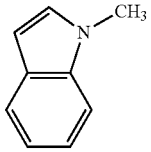
Exemplary Cpd (76)
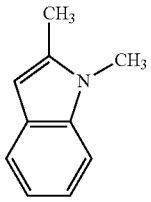
Exemplary Cpd (77)
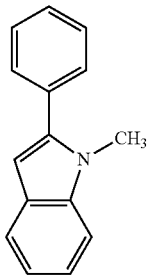
Exemplary Cpd (78)
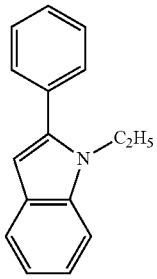
Exemplary Cpd (79)
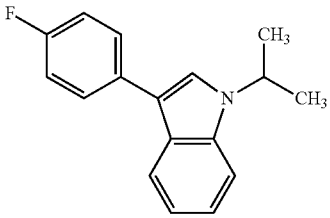
Exemplary Cpd (80)
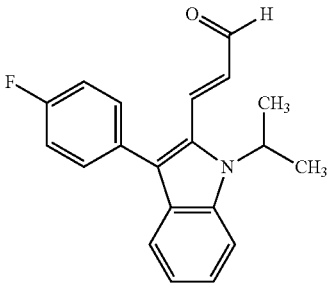
Exemplary Cpd (81)
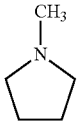

-continued
Exemplary Cpd (82)
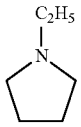
Exemplary Cpd (83)
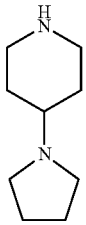
Exemplary Cpd (84)
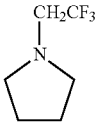
Exemplary Cpd (85)
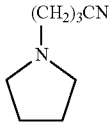
Exemplary Cpd (86)
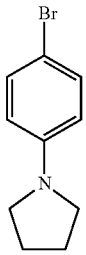
Exemplary Cpd (87)
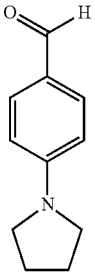
Exemplary Cpd (88)
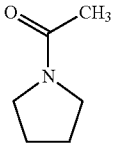
Exemplary Cpd (89)
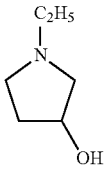
-continued
Exemplary Cpd (90)
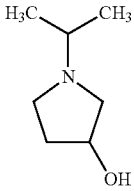
Exemplary Cpd (91)
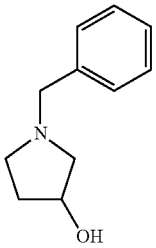
Exemplary Cpd (92)
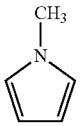
Exemplary Cpd (93)
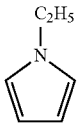
Exemplary Cpd (94)
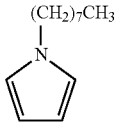
Exemplary Cpd (95)
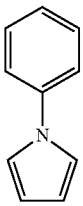
Exemplary Cpd (96)
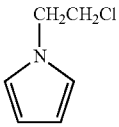
Exemplary Cpd (97)
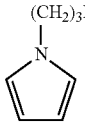
Exemplary Cpd (98)
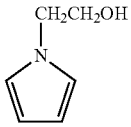

-continued
Exemplary Cpd (99)
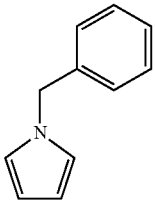
Exemplary Cpd (100)
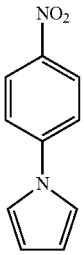
Exemplary Cpd (101)
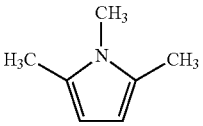
Exemplary Cpd (102)
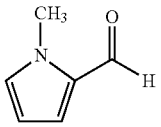
Exemplary Cpd (103)
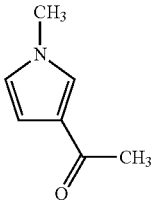
Exemplary Cpd (104)
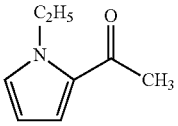
Exemplary Cpd (105)
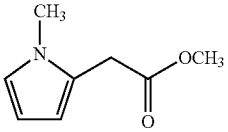
Exemplary Cpd (106)
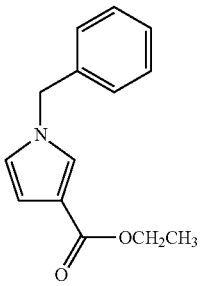
-continued
Exemplary Cpd (107)
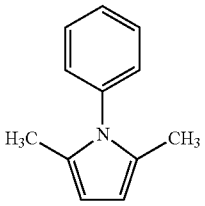
Exemplary Cpd (108)
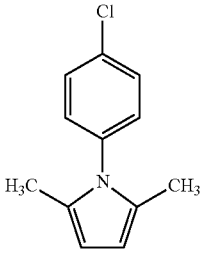
Exemplary Cpd (109)
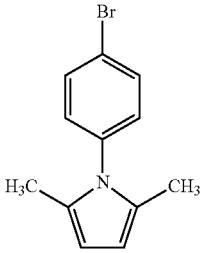
Exemplary Cpd (110)
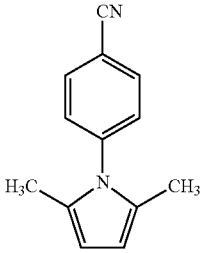
Exemplary Cpd (111)
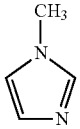
Exemplary Cpd (112)
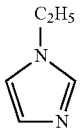
Exemplary Cpd (113)
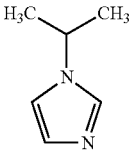
Exemplary Cpd (114)
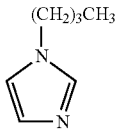

-continued
Exemplary Cpd (115)
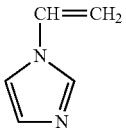
Exemplary Cpd (116)
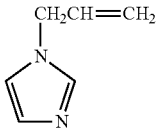
Exemplary Cpd (117)
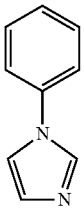
Exemplary Cpd (118)
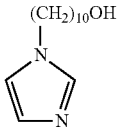
Exemplary Cpd (119)
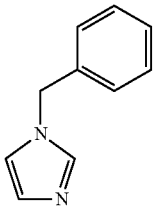
Exemplary Cpd (120)
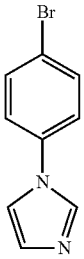
Exemplary Cpd (121)
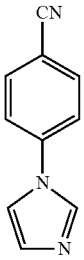
-continued
Exemplary Cpd (122)
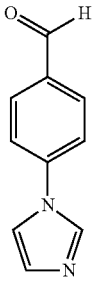
Exemplary Cpd (123)
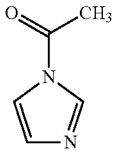
Exemplary Cpd (124)
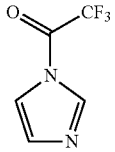
Exemplary Cpd (125)
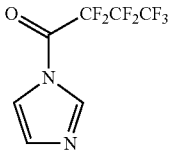
Exemplary Cpd (126)
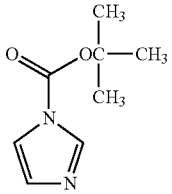
Exemplary Cpd (127)
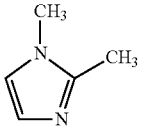
Exemplary Cpd (128)
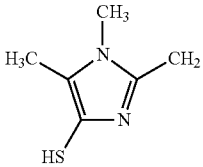
Exemplary Cpd (129)
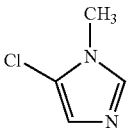
Exemplary Cpd (130)
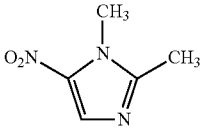

-continued
Exemplary Cpd (131)
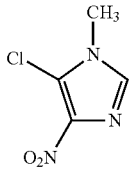
Exemplary Cpd (132)
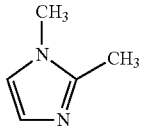
Exemplary Cpd (133)
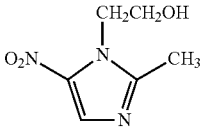
Exemplary Cpd (134)
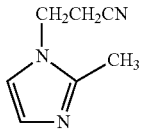
Exemplary Cpd (135)
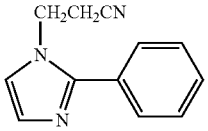
Exemplary Cpd (136)
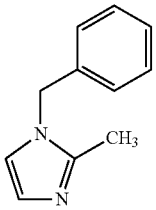
Exemplary Cpd (137)
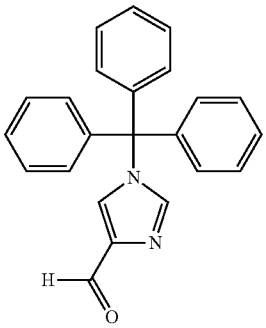
Exemplary Cpd (138)
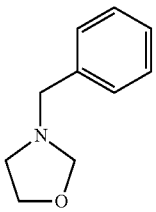
-continued
Exemplary Cpd (139)
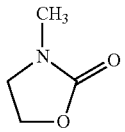
Exemplary Cpd (140)
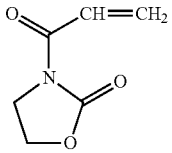
Exemplary Cpd (141)
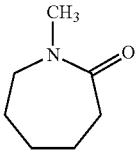
Exemplary Cpd (142)
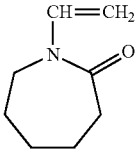
Exemplary Cpd (143)
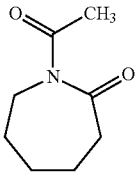
Exemplary Cpd (144)
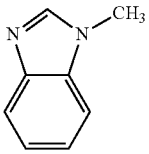
Exemplary Cpd (145)
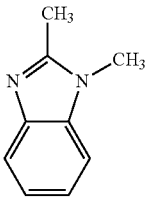
Exemplary Cpd (146)
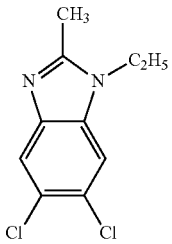

-continued
Exemplary Cpd (147)
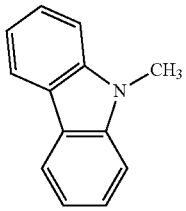
Exemplary Cpd (148)
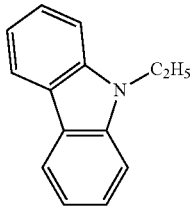
Exemplary Cpd (149)
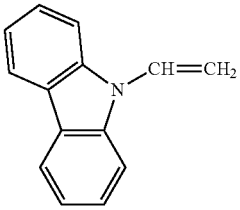
Exemplary Cpd (150)
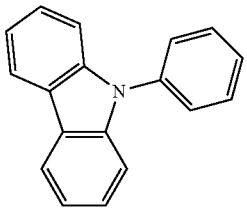
Exemplary Cpd (151)
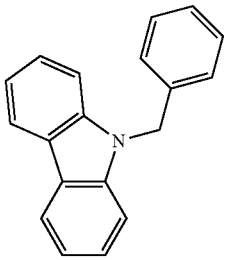
Exemplary Cpd (152)
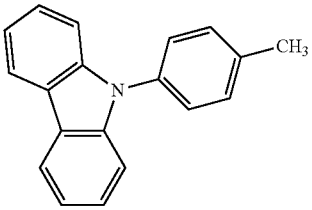
-continued
Exemplary Cpd (153)
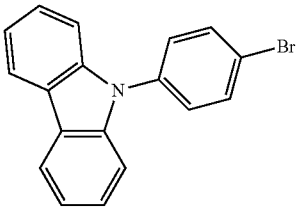
Exemplary Cpd (154)
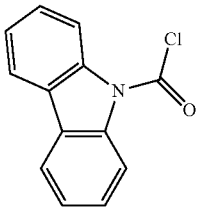
Exemplary Cpd (155)
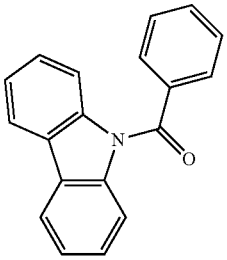
Exemplary Cpd (156)
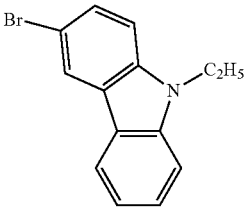
Exemplary Cpd (157)
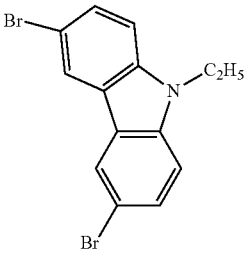
Exemplary Cpd (158)
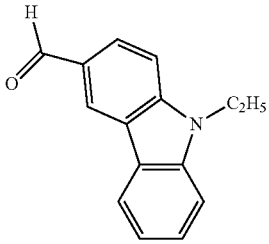

-continued
Exemplary Cpd (159)
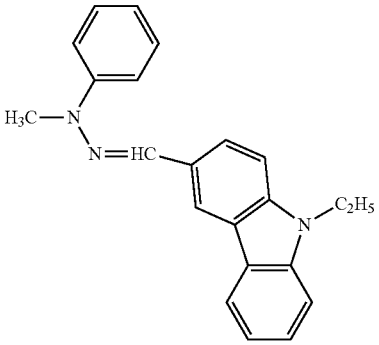
Exemplary Cpd (160)
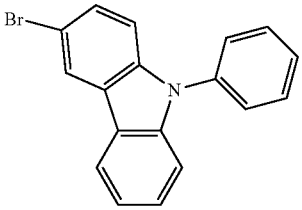
Exemplary Cpd (161)
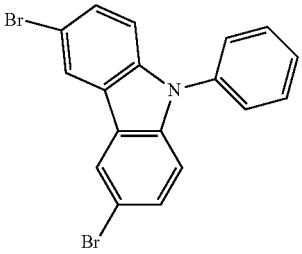
Exemplary Cpd (162)
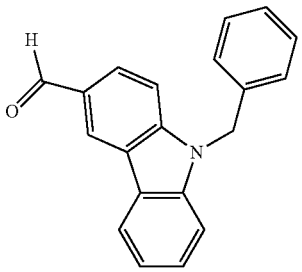
Exemplary Cpd (163)
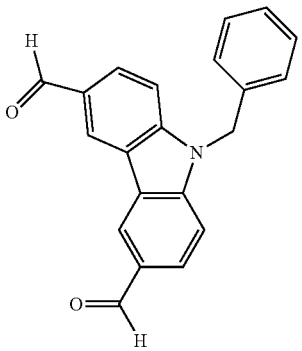
-continued
Exemplary Cpd (164)
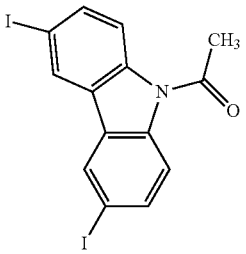
Exemplary Cpd (165)
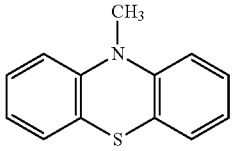
Exemplary Cpd (166)
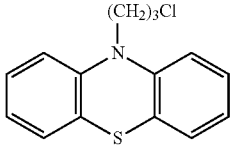
Exemplary Cpd (167)
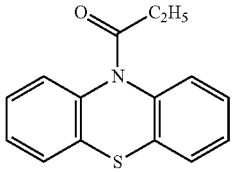
Exemplary Cpd (168)
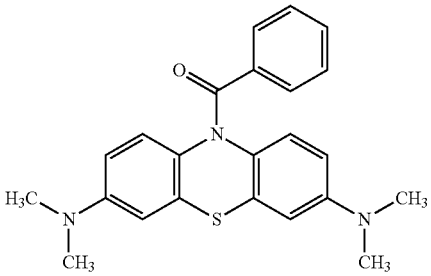
Exemplary Cpd (169)
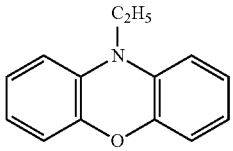
Exemplary Cpd (170)
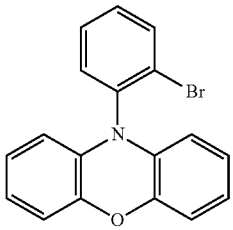

-continued

Exemplary Cpd (171)

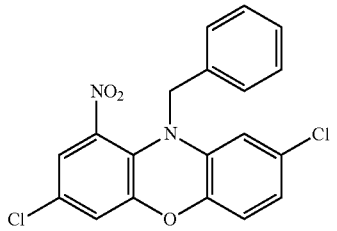

Exemplary Cpd (172)

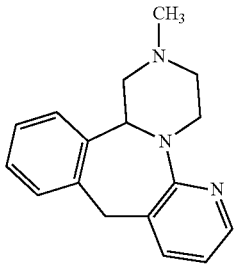

Examples of the gallium phthalocyanine crystal contained in the electrophotographic photosensitive member according to the present invention include those including a gallium phthalocyanine molecule in which a gallium atom has a halogen atom, a hydroxy group or an alkoxy group as an axial ligand. The phthalocyanine ring may have a substituent such as a halogen atom.

The gallium phthalocyanine crystal can be a gallium phthalocyanine crystal in which N,N-dimethylformamide is contained.

Among these gallium phthalocyanine crystals, hydroxygallium phthalocyanine crystals, bromogallium phthalocyanine crystals and iodogallium phthalocyanine crystals having high sensitivity are preferable because these effectively act in the present invention. Among these, hydroxygallium phthalocyanine crystals are more preferable. In the hydroxygallium phthalocyanine crystals, a gallium atom has a hydroxy group as an axial ligand. In the bromogallium phthalocyanine crystals, a gallium atom has a bromine atom as an axial ligand. In the iodogallium phthalocyanine crystals, a gallium atom has an iodine atom as an axial ligand.

Among these hydroxygallium phthalocyanine crystals, hydroxygallium phthalocyanine crystals having a crystal form having peaks at Bragg angles 2θ of 7.4°±0.3° and 28.2°±0.3° in X-ray diffraction with CuKα radiation are particularly preferable because images with high quality are attained.

The gallium phthalocyanine crystal containing the nitrogen-containing heterocyclic compound within the crystal means that the nitrogen-containing heterocyclic compound is incorporated into the crystal.

The method of preparing a gallium phthalocyanine crystal containing the nitrogen-containing heterocyclic compound within the crystal will be described.

The gallium phthalocyanine crystal containing the nitrogen-containing heterocyclic compound within the crystal according to the present invention is prepared by mixing gallium phthalocyanine prepared by acid pasting and a nitrogen-containing heterocyclic compound with a solvent, and converting the mixture into crystals by wet milling.

The milling here is a treatment performed with a dispersant such as glass beads, steel beads and alumina balls in a milling apparatus such as a sand mill and a ball mill. The milling time can be approximately 10 to 60 hours. In a particularly preferable method, a sample is taken every 5 to 10 hours to examine the Bragg angle of the crystal. The amount of the dispersant to be used in milling can be 10 to 50 times that of gallium phthalocyanine in terms of mass. Examples of the solvent to be used include amide solvents such as N,N-dimethylformamide, N,N-dimethylacetamide, N-methylformamide, N-methylacetoamide and N-methylpropioamide; halogen-containing solvents such as chloroform; ether solvents such as tetrahydrofuran; and sulfoxide solvents such as dimethyl sulfoxide. The amount of the solvent to be used can be 5 to 30 times that of gallium phthalocyanine in terms of mass. The amount of the nitrogen-containing heterocyclic compound to be used can be 0.1 to 10 times that of gallium phthalocyanine in terms of mass.

The prepared gallium phthalocyanine crystal is measured by NMR and thermogravimetry (TG) to analyze the obtained data to thereby determine whether the gallium phthalocyanine crystal according to the present invention contains the nitrogen-containing heterocyclic compound within the crystal.

For example, when the nitrogen-containing heterocyclic compound is milled with a solvent that can dissolve the compound or when the nitrogen-containing heterocyclic compound is milled and washed with such a solvent, the prepared gallium phthalocyanine crystal is measured by NMR. Detection of the nitrogen-containing heterocyclic compound indicates that the nitrogen-containing heterocyclic compound is contained within the crystal.

In contrast, when the nitrogen-containing heterocyclic compound is insoluble in the solvent used for milling and also insoluble in a washing solvent used after milling, the prepared gallium phthalocyanine crystal is analyzed by NMR. If the nitrogen-containing heterocyclic compound is detected, the following method is used to determine whether the nitrogen-containing heterocyclic compound is contained within the crystal.

The gallium phthalocyanine crystal prepared by adding the nitrogen-containing heterocyclic compound, a gallium phthalocyanine crystal prepared similarly without adding the nitrogen-containing heterocyclic compound and the nitrogen-containing heterocyclic compound alone are individually analyzed by TG. When the result of TG analysis of the gallium phthalocyanine crystal prepared by adding the nitrogen-containing heterocyclic compound can be interpreted as a mixture of the result of TG analysis of the gallium phthalocyanine crystal prepared without adding the nitrogen-containing heterocyclic compound and that on the nitrogen-containing heterocyclic compound alone in a predetermined ratio, the result can be determined as follows. Namely, detection of the nitrogen-containing heterocyclic compound in this case indicates that a mixture of the gallium phthalocyanine crystal and the nitrogen-containing heterocyclic compound is generated, or the nitrogen-containing heterocyclic compound simply adheres to the surfaces of the gallium phthalocyanine crystals.

When the result of TG analysis of the gallium phthalocyanine crystal prepared by adding the target nitrogen-containing heterocyclic compound exhibits a reduction in weight at a temperature higher than that in TG analysis of the target nitrogen-containing heterocyclic compound alone, the result can be determined as follows. Namely, detection of the nitrogen-containing heterocyclic compound indicates that the nitrogen-containing heterocyclic compound is contained within the gallium phthalocyanine crystal.

The gallium phthalocyanine crystal contained in the electrophotographic photosensitive member according to the present invention is analyzed by TG, X-ray diffraction and NMR under the following conditions.

[TG Analysis]

Analyzer to be used: manufactured by Seiko Instruments Inc., TG/DTA simultaneous analyzer (trade name: TG/DTA220U)

Atmosphere: under a nitrogen stream (300 $m^3$/min)
Range for analysis: 35° C. to 600° C.
Temperature raising rate: 10° C./min

[Powder X-Ray Diffraction Analysis]

Analyzer to be used: manufactured by Rigaku Corporation, X-ray diffraction apparatus RINT-TTRII
X-ray tube: Cu
Tube voltage: 50 KV
Tube current: 300 mA
Scanning method: 2θ/θ scan
Scanning rate: 4.0°/min
Sampling interval: 0.02°
Start angle (2θ): 5.0°
Stop angle (2θ): 40.0°
Attachment: standard sample holder
Filter: not used
Incident monochromator: used
Counter monochromator: not used
Divergence slit: opened
Vertical divergence limiting slit: 10.00 mm
Scattering slit: opened
Receiving slit: opened
Flat plate monochromator: used
Counter: scintillation counter

[NMR Analysis]

Analyzer to be used: manufactured by BRUKER Corporation, AVANCEIII 500
Solvent: sodium bisulfate ($D_2SO_4$)

A resin having a structural unit represented by Formula (1) used in the present invention (hereinafter, also referred to as "polyvinyl acetal according to the present invention") can be synthesized by a standard method for synthesizing a butyral resin. Namely, the resin can be synthesized by reacting polyvinyl alcohol with aldehyde having an electron-donating, substituted triarylamine skeleton in a mixed solvent of ethanol and toluene, for example, in the presence of an acid such as hydrochloric acid or sulfuric acid at 20 to 70° C.

The resin having a structural unit represented by Formula (1) has a weight average molecular weight in the range of preferably 10,000 to 500,000, more preferably 30,000 to 100,000. A molecular weight within this range attains high dispersion stability of the charge generating substance and good film forming properties of the layer, and is thus more preferable.

A degree of acetalization of the polyvinyl acetal resin according to the present invention is preferably 30 mol % or more, more preferably 50 to 85 mol %. A degree of acetalization within this range attains high solubility of the resin in a solvent.

Polyvinyl acetal according to the present invention can contain a smaller content of the remaining vinyl acetate component, which is derived from polyvinyl alcohol as a raw material. For the raw material, polyvinyl alcohol having a degree of saponification of 85% or more can be used. A degree of saponification of less than 85% readily reduces the degree of acetalization.

Examples of the electron-donating substituent include alkyl groups such as a methyl group, an ethyl group and a propyl group; alkoxy groups such as a methoxy group and ethoxy group; a phenyl group, a phenoxy group and a benzyl group.

When the polyvinyl acetal resin according to the present invention is used in the photosensitive layer (charge generating layer) of the electrophotographic photosensitive member, an additional resin may be mixed with the polyvinyl acetal resin according to the present invention for use. The mixing ratio of the polyvinyl acetal resin according to the present invention is preferably 50% by mass or more, more preferably 70% by mass or more based on the total mass of the resins.

Now, specific examples of the resin having a structural unit represented by Formula (1) (Exemplary resins) will be shown. $X^1$, $R^5$, $R^6$, $R^7$, $R^8$, $Ar^1$ and $Ar^2$ in Formulae are the same as $X^1$, $R^5$, $R^6$, $R^7$, $R^8$, $Ar^1$ and $Ar^2$ in Formula (1).

Exemplary Resin (1)

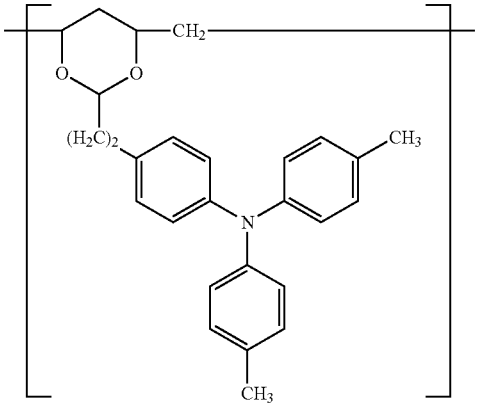

Exemplary Resin (2)

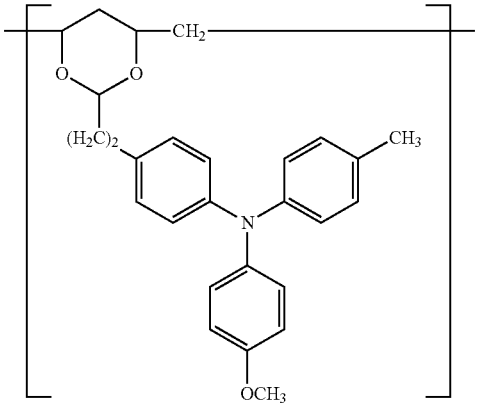

Exemplary Resin (3)

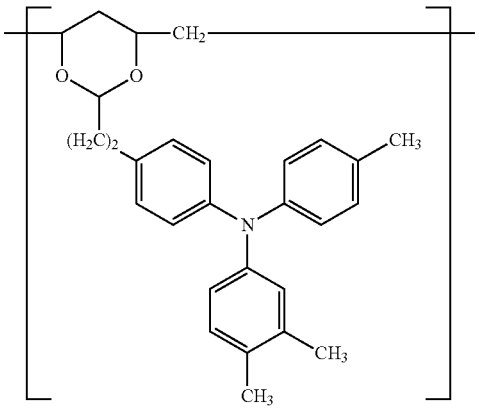

-continued
Exemplary Resin (4)
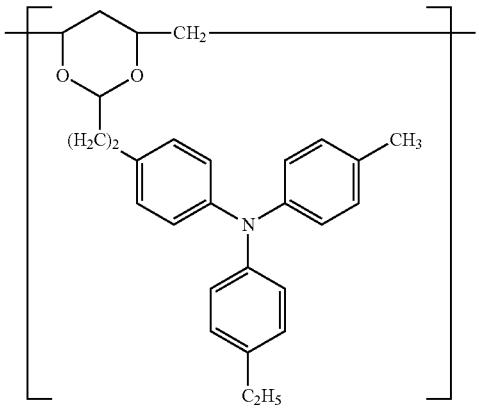
Exemplary Resin (5)
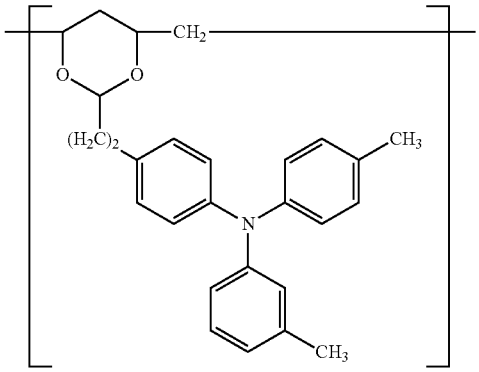
Exemplary Resin (6)
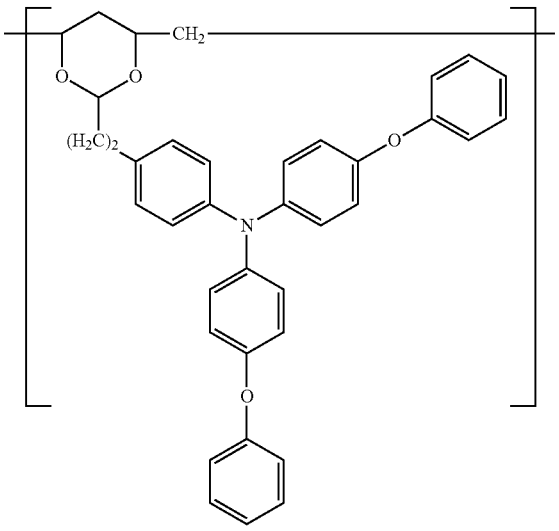
-continued
Exemplary Resin (7)
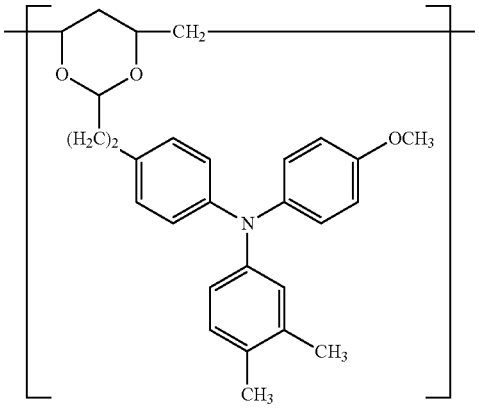
Exemplary Resin (8)
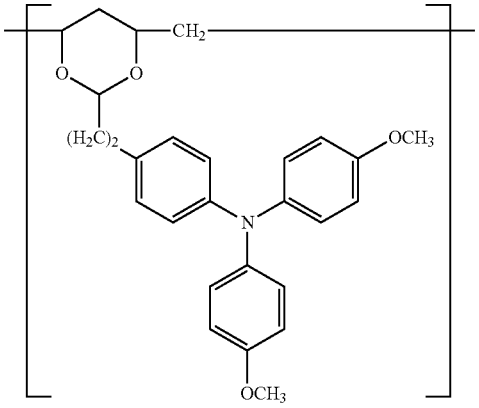
Exemplary Resin (9)
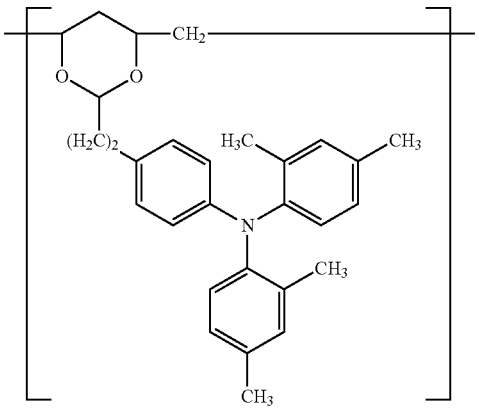

-continued

Exemplary Resin (10)

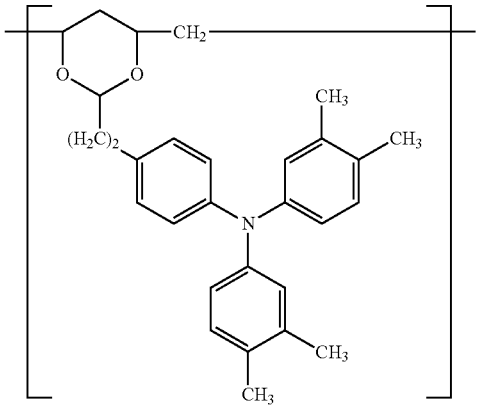

Exemplary Resin (11)

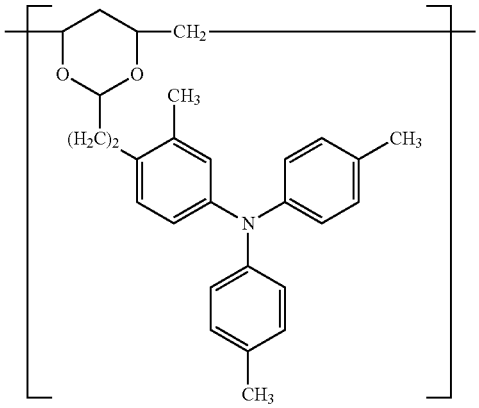

Exemplary Resin (12)

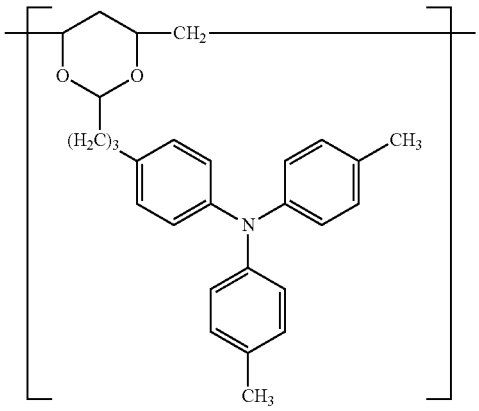

-continued

Exemplary Resin (13)

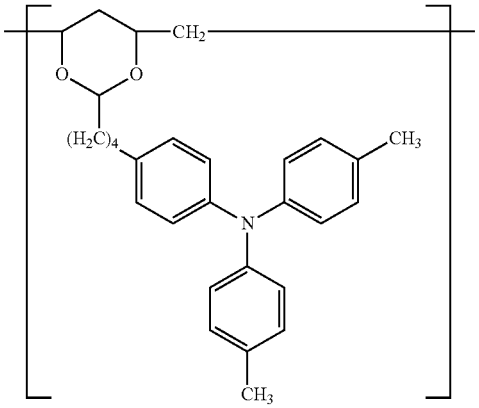

In Formula (1), $X^1$ can be an ethylene group (unsubstituted ethylene group). $R^5$, $R^6$, $R^7$ and $R^8$ all can be a hydrogen atom. The electron-donating substituent in $Ar^1$ and $Ar^2$ can be an alkyl group. Among these, a methyl group or an ethyl group is more preferable.

The photosensitive layer included in the electrophotographic photosensitive member according to the present invention is a laminate photosensitive layer including a charge generating layer and a charge transporting layer disposed thereon. The charge generating layer is as described above. The charge transporting layer contains a charge transport substance.

The support used in the present invention may have conductivity (may be a conductive support). Examples of the material for the support include metals such as aluminum and stainless steel and alloys thereof, and metals, alloys, plastics and papers having a conductive layer. Examples of shapes of the support include cylindrical shapes and film-like shapes.

In the present invention, an undercoat layer having barrier function and bonding function (also referred to as an intermediate layer) can be disposed between the support and the photosensitive layer.

Examples of the material for the undercoat layer to be used include polyvinyl alcohol, polyethylene oxide, ethyl cellulose, methyl cellulose, casein, polyamide, glue and gelatin. These are dissolved in a proper solvent to be applied onto the support.

The undercoat layer can have a thickness of 0.3 to 5.0 μm.

A conductive layer is suitably disposed between the support and the undercoat layer to cover unevenness and defects of the support and prevent interference fringes.

The conductive layer can be formed by dispersing carbon black, metal particles and conductive particles of e.g. metal oxides in a binder resin.

The conductive layer has a thickness of preferably 5 to 40 μm, particularly preferably 10 to 30 μm.

The charge generating layer can be disposed as follows: the gallium phthalocyanine crystal and nitrogen-containing heterocyclic compound are dispersed in a solvent with the resin having a structural unit represented by Formula (1) to prepare a coating solution for a charge generating layer. The coating solution for a charge generating layer is applied to form a coating. The coating is dried.

The dispersion can be performed with a dispersing machine such as medium type dispersing machines (e.g., sand mills and ball mills) or a solution collision type dispersing machine.

The ratio of the gallium phthalocyanine crystal (A) and the nitrogen-containing heterocyclic compound (B) to the resin (C) having a structural unit represented by Formula (1) in the charge generating layer can be [(A)+(B)]:(C)=5:1 to 1:2 (mass ratio).

The ratio of the gallium phthalocyanine crystal to the nitrogen-containing heterocyclic compound can be (A):(B)= 99.99:0.01 to 80:20 (mass ratio).

The charge generating layer has a thickness of preferably 5 μm or less, more preferably 0.05 to 1 μm.

The charge transporting layer can be disposed as follows: mainly a charge transport substance and a binder resin are dissolved in a solvent to prepare a coating solution for a charge transporting layer. The coating solution is applied to form a coating. The coating is dried.

The charge transporting layer has a thickness of preferably 5 to 40 μm, particularly preferably 10 to 25 μm.

The content of the charge transport substance is preferably 20 to 80% by mass, particularly preferably 30 to 60% by mass based on the total mass of the charge transporting layer.

Examples of the charge transport substance include a variety of triarylamine compounds, hydrazone compounds, stilbene compounds, pyrazoline compounds, oxazole compounds, thiazole compounds and triallylmethane compounds. Among these, preferable charge transport substances are triarylamine compounds.

Examples of the binder resin used for the charge transporting layer include resins such as polyester resins, acrylic resins, phenoxy resins, polycarbonate resins, polystyrene resins, polyvinyl acetate resins, polysulfone resins, polyarylate resins, vinylidene chloride resins and acrylonitrile copolymers. Among these, polycarbonate resins and polyarylate resins are preferable.

For the methods of applying the respective layers, coating methods such as immersion coating (dipping), spray coating, spinner coating, bead coating, blade coating and beam coating can be used.

A protective layer may be disposed on the photosensitive layer to protect the photosensitive layer.

The protective layer can be disposed as follows: a resin is dissolved in a proper organic solvent to prepare a coating solution for a protective layer. The coating solution is applied onto the photosensitive layer, and is dried. Examples of the resin used for the protective layer include polyvinyl butyral resins, polyester resins, polycarbonate resins (such as polycarbonate Z resins and modified polycarbonate resins), nylon resins, polyimide resins, polyarylate resins, polyurethane resins, styrene-butadiene copolymers, styrene-acrylic acid copolymers and styrene-acrylonitrile copolymers. The protective layer can also be disposed by applying the coating solution for a protective layer onto the photosensitive layer, and curing the coating solution by heating, an electron beam, ultraviolet light or the like. The protective layer can have a thickness of preferably 0.05 to 20 μm.

The protective layer may contain conductive particles, an ultraviolet absorbing agent and lubricating particles such as resin fine particles containing a fluorine atom. Preferable examples of the conductive particles include metal oxide particles such as tin oxide particles.

FIG. 1 is a drawing illustrating an example of a schematic configuration of an electrophotographic apparatus including the process cartridge including an electrophotographic photosensitive member according to the present invention.

A cylindrical (drum-shaped) electrophotographic photosensitive member 1 is rotated about an axis 2 in the arrow direction at a predetermined circumferential speed (process speed) for driving.

The surface of the electrophotographic photosensitive member 1 is charged positively or negatively at a predetermined potential by a charging unit 3 while the electrophotographic photosensitive member 1 is being rotated. The charged surface of the electrophotographic photosensitive member 1 is irradiated with image exposing light 4 from an image exposing unit (not illustrated) to form an electrostatic latent image corresponding to the information on the target image. The image exposing light 4 is the light whose intensity is modulated in correspondence with the time-series electric digital image signals indicating the information on the target image, which are output from an image exposing unit through slit exposure, exposure by laser beam scanning or the like.

The electrostatic latent image formed on the surface of the electrophotographic photosensitive member 1 is developed (normal development or reversal development) with a toner accommodated in a developing unit 5 to form a toner image on the surface of the electrophotographic photosensitive member 1. The toner image formed on the surface of the electrophotographic photosensitive member 1 is transferred onto a transfer material 7 by a transferring unit 6. At this time, a bias voltage having a polarity opposite to that of the toner charged is applied to the transferring unit 6 from a bias power supply (not illustrated). When the transfer material 7 is paper, the transfer material 7 is taken out from a paper feeding unit (not illustrated) and fed between the electrophotographic photosensitive member 1 and the transferring unit 6 in synchronization with rotation of the electrophotographic photosensitive member 1.

The transfer material 7 having the toner image transferred from the electrophotographic photosensitive member 1 is separated from the surface of the electrophotographic photosensitive member 1, and is fed to an image fixing unit 8 to fix the toner image. The transfer material 7 is thereby printed out to the outside of the electrophotographic apparatus as an image-formed product (print, copy).

After the toner image is transferred onto the transfer material 7, the surface of the electrophotographic photosensitive member 1 is cleaned by removing adherents such as the toner (transfer remaining toner) by a cleaning unit 9. The transfer remaining toner can be also directly removed by the developing unit or the like in a cleaner-less system developed in these days. The surface of the electrophotographic photosensitive member 1 is discharged with pre-exposing light 10 from a pre-exposing unit (not illustrated), and is repeatedly used for image formation. When the charging unit 3 is a contact charging unit including a charging roller, the pre-exposing unit is not always necessary.

In the present invention, a process cartridge is prepared by integrally supporting several components among the electrophotographic photosensitive member 1, the charging unit 3, the developing unit 5, the transferring unit 6 and the cleaning unit 9 which are put in a case. The process cartridge can be configured to be detachably mountable on the main body of the electrophotographic apparatus. For example, at least one selected from the group consisting of the charging unit 3, the developing unit 5, the transferring unit 6 and the cleaning unit 9 is supported integrally with the electrophotographic photosensitive member 1 to form a cartridge. The process cartridge 11 can be detachably mounted on the main body of the electrophotographic apparatus with a guiding unit 12 such as a rail provided in the main body of the electrophotographic apparatus.

The image exposing light 4 may be light reflected from or transmitted through an original manuscript when the electrophotographic apparatus is a copier or a printer. Alternatively, the image exposing light 4 may be the light emitted by, for example, scanning with a laser beam or driving of an LED array or a liquid crystal shutter array according to the signals obtained by reading the manuscript with a sensor.

The electrophotographic photosensitive member 1 according to the present invention can be widely used in application fields of electrophotography such as laser beam printers, CRT printers, LED printers, FAX machines, liquid crystal printers and laser plate making.

EXAMPLES

Now, the present invention will be described more in detail using specific Examples. The unit "parts" means "parts by mass" below. The present invention will not be limited to these. The thicknesses of the respective layers included in the electrophotographic photosensitive members in Examples and Comparative Examples were determined by a method using an eddy current coating thickness measuring apparatus (Fischerscope, manufactured by Helmut Fischer GmbH) or a method of calculating a specific gravity from the mass per unit area.

Synthesis Example 1

Under an atmosphere with a nitrogen stream, phthalonitrile (5.46 parts) and α-chloronaphthalene (45 parts) were placed in a reaction vessel, were heated to a temperature of 30° C., and were kept at this temperature. Next, at this temperature (30° C.), gallium trichloride (3.75 parts) was added. At this time, the moisture content of the mixed solution was 150 ppm. Subsequently, the temperature was raised to 200° C. Next, under an atmosphere with a nitrogen stream, the reaction was made at a temperature of 200° C. for 4.5 hours. The reaction product was cooled, and was filtered when the temperature reached 150° C. The filtered product thus obtained was dispersed and washed with N,N-dimethylformamide at a temperature of 140° C. for 2 hours, and was filtered. The filtered product thus obtained was washed with methanol, and was dried to prepare a chlorogallium phthalocyanine pigment (4.65 parts, yield: 71%).

Next, the chlorogallium phthalocyanine pigment (4.65 parts) thus obtained was dissolved in concentrated sulfuric acid (139.5 parts) at a temperature of 10° C., and was dropped into ice water (620 parts) under stirring to be reprecipitated. The resultant product was filtered through a filter press. The wet cake (filtered product) thus obtained was dispersed and washed with 2% aqueous ammonia, and was filtered through a filter press. Subsequently, the wet cake (filtered product) thus obtained was then dispersed and washed with ion exchange water, and was filtered through a filter press. This operation was repeated 3 times to prepare a hydroxygallium phthalocyanine pigment (solid content; 23%) (hydrated hydroxygallium phthalocyanine pigment).

Synthesis Example 2

Under an atmosphere with a nitrogen stream, phthalonitrile (5.46 parts) and α-chloronaphthalene (45 parts) were placed in a reaction vessel, were heated to a temperature of 30° C., and were kept at this temperature. Next, at this temperature (30° C.), gallium trichloride (3.75 parts) was added. At this time, the moisture content of the mixed solution was 150 ppm. Subsequently, the temperature was raised to 200° C. Next, under an atmosphere with a nitrogen stream, the reaction was made at a temperature of 200° C. for 4.5 hours. The reaction product was cooled, and was filtered when the temperature reached 150° C. The filtered product thus obtained was dispersed and washed with N,N-dimethylformamide at a temperature of 140° C. for 2 hours, and was filtered. The filtered product thus obtained was washed with methanol, and was dried to prepare a chlorogallium phthalocyanine pigment (4.65 parts, yield: 71%).

Example 1-1

The hydroxygallium phthalocyanine pigment prepared in Synthesis Example 1 (hydrated hydroxygallium phthalocyanine pigment, 6.6 kg) was dried with a hyper-dry dryer (trade name: HD-06R, frequency (oscillating frequency): 2455 MHz±15 MHz, manufactured by Biocon (Japan) Ltd.) as follows.

The hydroxygallium phthalocyanine pigment prepared in Synthesis Example 1 was placed on a dedicated circular plastic tray as a bulk extracted from the filter press (thickness of the hydrated cake: 4 cm or less). Far infrared rays were set to be OFF, and the temperature of the inner wall of the dryer was set to be 50° C. A vacuum pump and a leak valve were adjusted during irradiation with microwaves, and a degree of vacuum was adjusted to be 4.0 to 10.0 kPa.

First, in a first step, the hydroxygallium phthalocyanine pigment was irradiated with a microwave of 4.8 kW for 50 minutes. Next, the microwave was turned off, and the leak valve was closed to provide a high vacuum atmosphere at 2 kPa or less. At this time, the solid content of the hydroxygallium phthalocyanine pigment was 88%.

In a second step, the leak valve was adjusted to control the degree of vacuum (inner pressure of the dryer) to fall within the setting value (4.0 to 10.0 kPa). The hydroxygallium phthalocyanine pigment was irradiated with a microwave of 1.2 kW for 5 minutes. The microwave was turned off again, and the leak valve was closed to provide a high vacuum atmosphere at 2 kPa or less. The second step was repeated one more time (twice in total). At this time, the solid content of the hydroxygallium phthalocyanine pigment was 98%.

In a third step, the hydroxygallium phthalocyanine pigment was irradiated with a microwave in the same manner as in irradiation with a microwave in the second step except that the output of the microwave in the second step was changed from 1.2 kW to 0.8 kW. The third step was repeated one more time (twice in total).

In a fourth step, the leak valve was adjusted to return the degree of vacuum (inner pressure of the dryer) to a value within the setting range of pressure (4.0 to 10.0 kPa). The hydroxygallium phthalocyanine pigment was irradiated with a microwave of 0.4 kW for 3 minutes. The microwave was turned off, and the leak valve was closed to provide a high vacuum atmosphere at 2 kPa or less. The fourth step was repeated 7 times (8 times in total).

A hydroxygallium phthalocyanine crystal (pigment) having a hydration rate of 1% or less (1.52 kg) was thus prepared in 3 hours in total.

Figure 2:
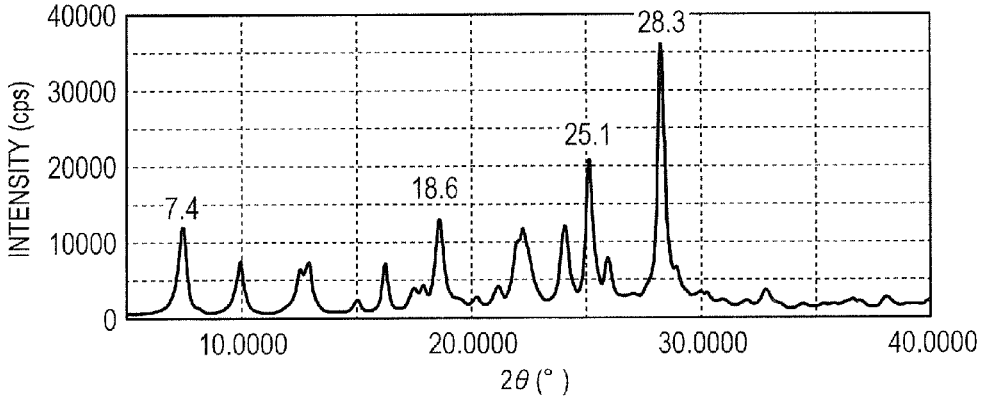
FIG. 2 is a drawing illustrating the result of powder X-ray diffraction of a hydroxygallium phthalocyanine crystal prepared in Example 1-1.

Next, the hydroxygallium phthalocyanine crystal (0.5 parts) thus obtained, Exemplary compound (7) (production code: P0196, manufactured by Tokyo Chemical Industry Co., Ltd., 2.0 parts), and N,N-dimethylformamide (9.5 parts) were milled with glass beads (15 parts, diameter: 0.8 mm) at room temperature (23° C.) for 45 hours in a ball mill. The gallium phthalocyanine crystal was extracted from the dispersion liquid with N,N-dimethylformamide, and was filtered. The gallium phthalocyanine crystal on the filter was sufficiently washed with tetrahydrofuran. The filtered product was vacuum dried to prepare a hydroxygallium phthalocyanine crystal (0.45 parts). The result of powder X-ray diffraction of the resulting crystal is shown in FIG. 2.

NMR analysis indicated that the hydroxygallium phthalocyanine crystal thus obtained contains 0.54% by mass Exemplary compound (7) and 2.13% by mass N,N-dimethylformamide in terms of the ratio of proton. Exemplary compound (7) is soluble in N,N-dimethylformamide. Accordingly, this indicates that Exemplary compound (7) is contained within the crystal.

Example 1-2

Figure 3:
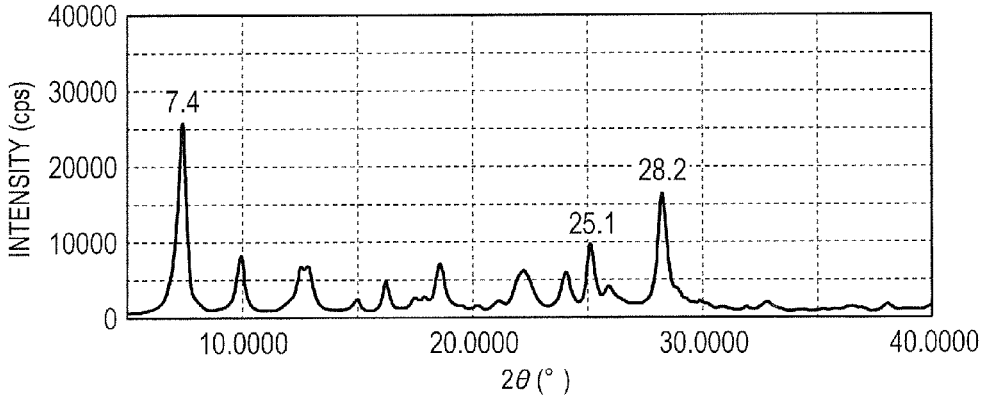
FIG. 3 is a drawing illustrating the result of powder X-ray diffraction of a hydroxygallium phthalocyanine crystal prepared in Example 1-2.

A hydroxygallium phthalocyanine crystal in Example 1-2 was prepared in the same manner as in Example 1-1 except that Exemplary compound (7) used in Example 1-1 (2.0 parts) was not used. The result of powder X-ray diffraction of the resulting crystal is shown in FIG. 3.

Example 1-3

The amount of Exemplary compound (7) used in Example 1-1 (2.0 parts) was changed to 1.0 part. Instead of milling with a ball mill for 45 hours, milling was performed with a paint shaker (manufactured by Toyo Seiki Seisaku-sho, Ltd.) for 21 hours. Except these, a hydroxygallium phthalocyanine crystal in Example 1-3 was prepared in the same manner as in Example 1-1. The result of powder X-ray diffraction of the resulting crystal is similar to that shown in FIG. 2.

Similarly to Example 1-1, NMR analysis indicated that the hydroxygallium phthalocyanine crystal contains 0.19% by mass Exemplary compound (7) and 2.28% by mass N,N-dimethylformamide.

Example 1-4

A hydroxygallium phthalocyanine crystal in Example 1-4 was prepared in the same manner as in Example 1-1 except that Exemplary compound (7) used in Example 1-1 (2.0 parts) was replaced by Exemplary compound (16) (production code: T2215, manufactured by Tokyo Chemical Industry Co., Ltd.) (1.0 part). The result of powder X-ray diffraction of the resulting crystal is similar to that shown in FIG. 2.

Similarly to Example 1-1, NMR analysis indicated that the hydroxygallium phthalocyanine crystal contains 0.70% by mass Exemplary compound (16) and 2.04% by mass N,N-dimethylformamide.

Example 1-5

Figure 4:
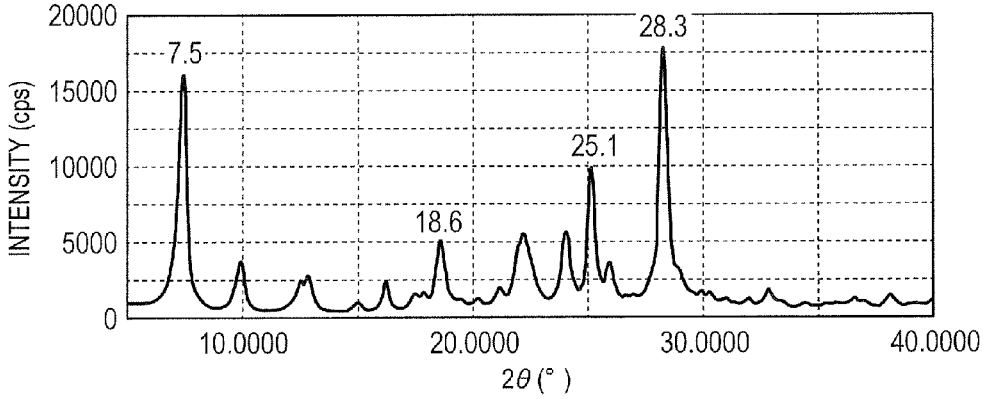
FIG. 4 is a drawing illustrating the result of powder X-ray diffraction of a hydroxygallium phthalocyanine crystal prepared in Example 1-5.

A hydroxygallium phthalocyanine crystal in Example 1-5 was prepared in the same manner as in Example 1-1 except that Exemplary compound (7) used in Example 1-1 (2.0 parts) was replaced by Exemplary compound (9) (production code: P1646, manufactured by Tokyo Chemical Industry Co., Ltd.) (1.0 part). The result of powder X-ray diffraction of the resulting crystal is shown in FIG. 4.

Similarly to Example 1-1, NMR analysis indicated that the hydroxygallium phthalocyanine crystal contains 1.67% by mass Exemplary compound (9) and 1.79% by mass N,N-dimethylformamide.

Example 1-6

Exemplary compound (7) used in Example 1-1 (2.0 parts) was replaced by Exemplary compound (66) (1.0 part). The milling time with a ball mill was changed from 45 hours to 50 hours. Except these, a hydroxygallium phthalocyanine crystal in Example 1-6 was prepared in the same manner as in Example 1-1. The result of powder X-ray diffraction of the resulting crystal is similar to that shown in FIG. 2.

Similarly to Example 1-1, NMR analysis indicated that the hydroxygallium phthalocyanine crystal contains 0.06% by mass Exemplary compound (66) and 1.93% by mass N,N-dimethylformamide.

Example 1-7

A hydroxygallium phthalocyanine crystal in Example 1-7 was prepared in the same manner as in Example 1-1 except that Exemplary compound (7) used in Example 1-1 (2.0 parts) was replaced by Exemplary compound (10) (production code: F0157, manufactured by Tokyo Chemical Industry Co., Ltd.) (1.0 part). The result of powder X-ray diffraction of the resulting crystal is similar to that shown in FIG. 2.

Similarly to Example 1-1, NMR analysis indicated that the hydroxygallium phthalocyanine crystal contains 0.22% by mass Exemplary compound (10) and 2.34% by mass N,N-dimethylformamide.

Example 1-8

A hydroxygallium phthalocyanine crystal in Example 1-8 was prepared in the same manner as in Example 1-1 except that Exemplary compound (7) used in Example 1-1 (2.0 parts) was replaced by Exemplary compound (1) (production code: M0370, manufactured by Tokyo Chemical Industry Co., Ltd.) (0.5 parts). The result of powder X-ray diffraction of the resulting crystal is similar to that shown in FIG. 2.

Similarly to Example 1-1, NMR analysis indicated that the hydroxygallium phthalocyanine crystal contains 0.38% by mass Exemplary compound (1) and 2.04% by mass N,N-dimethylformamide.

Example 1-9

A hydroxygallium phthalocyanine crystal in Example 1-9 was prepared in the same manner as in Example 1-8 except that the amount of Exemplary compound (1) used in Example 1-8 (0.5 parts) was changed to 2.0 parts and N,N-dimethylformamide was replaced by dimethyl sulfoxide. The result of powder X-ray diffraction of the resulting crystal is similar to that shown in FIG. 2.

Similarly to Example 1-1, NMR analysis indicated that the hydroxygallium phthalocyanine crystal contains 1.29% by mass Exemplary compound (1) and 2.30% by mass dimethyl sulfoxide.

Example 1-10

A hydroxygallium phthalocyanine crystal in Example 1-10 was prepared in the same manner as in Example 1-1 except that Exemplary compound (7) used in Example 1-1 (2.0 parts) was replaced by Exemplary compound (2) (production code: E0145, manufactured by Tokyo Chemical Industry Co., Ltd.) (1.0 part). The result of powder X-ray diffraction of the resulting crystal is similar to that shown in FIG. 2.

Similarly to Example 1-1, NMR analysis indicated that the hydroxygallium phthalocyanine crystal contains 0.63% by mass Exemplary compound (2) and 2.13% by mass N,N-dimethylformamide.

Comparative Example 1-1

Exemplary compound (7) used in Example 1-1 (2.0 parts) was replaced by a nitrogen-containing heterocyclic compound represented by Formula (7) (production code: M0465, manufactured by Tokyo Chemical Industry Co., Ltd.) (1.0 part):

Formula (7)

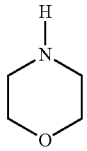

Except that, a hydroxygallium phthalocyanine crystal in Comparative Example 1-1 was prepared in the same manner as in Example 1-1. The result of powder X-ray diffraction of the resulting crystal is similar to that shown in FIG. 3.

Similarly to Example 1-1, NMR analysis indicated that the hydroxygallium phthalocyanine crystal contains 0.55% by mass nitrogen-containing heterocyclic compound represented by Formula (7) and 2.03% by mass N,N-dimethylformamide.

Example 2-1

An aluminum cylinder having a diameter of 24 mm and a length of 257 mm was used as a support (cylindrical support).

Next, a barium sulfate particle coated with tin oxide (trade name: Passtran PC1, manufactured by Mitsui Mining & Smelting Co., Ltd.) (60 parts), a titanium oxide particle (trade name: TITANIX JR, manufactured by Tayca Corporation) (15 parts), a resol phenol resin (trade name: PHENOLITE J-325, manufactured by DIC Corporation, solid content: 70% by mass) (43 parts), silicone oil (trade name: SH28PA, manufactured by Dow Corning Toray Silicone Co., Ltd.) (0.015 parts), a silicone resin particle (trade name: Tospearl 120, manufactured by Dow Corning Toray Co., Ltd.) (3.6 parts), 2-methoxy-1-propanol (50 parts) and methanol (50 parts) were placed in a ball mill, and were dispersed for 20 hours to prepare a coating solution for a conductive layer. The coating solution for a conductive layer was applied onto the support by immersion coating to form a coating. The coating was heated at 140° C. for 1 hour to be cured. A conductive layer having a thickness of 20 μm was thereby disposed.

Next, N-methoxymethylated nylon 6 (trade name: TORESIN EF-30T, manufactured by Nagase ChemteX Corporation) (25 parts) was dissolved (dissolved by heating at 65° C.) in a mixed solution of methanol/n-butanol=2/1 (480 parts), and the resultant solution was cooled. Subsequently, the solution was filtered through a membrane filter (trade name: FP-022, pore diameter: 0.22 μm, manufactured by Sumitomo Electric Industries, Ltd.) to prepare a coating solution for an undercoat layer. The coating solution for an undercoat layer thus prepared was applied onto the conductive layer by immersion to form a coating. The coating was dried by heating with an oven at a temperature of 100° C. for 10 minutes to dispose an undercoat layer having a thickness of 0.45 μm.

Next, the hydroxygallium phthalocyanine crystal prepared in Example 1-1 (charge generating substance) (20 parts), Exemplary resin (1) (10 parts) and cyclohexanone (519 parts) were placed in a sand mill containing glass beads having a diameter of 1 mm, and were dispersed for 4 hours. Subsequently, ethyl acetate (764 parts) was added to prepare a coating solution for a charge generating layer. The coating solution for a charge generating layer was applied onto the undercoat layer by immersion coating to form a coating. The coating was dried at 100° C. for 10 minutes to dispose a charge generating layer having a thickness of 0.18 μm.

Next, a triarylamine compound represented by Formula (8) (hole transport substance) (70 parts):

Formula (8)

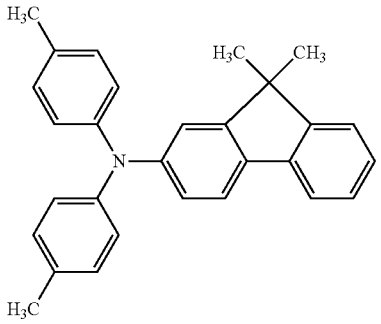

a triarylamine compound represented by Formula (9) (hole transport substance) (10 parts):

Formula (9)

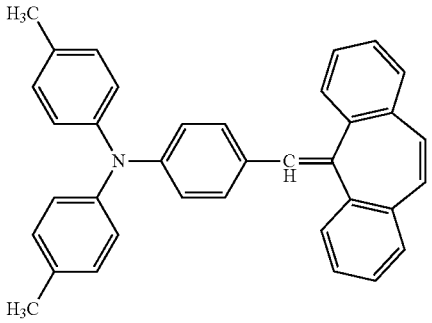

and polycarbonate (trade name: Iupilon Z-200, manufactured by Mitsubishi Engineering-Plastics Corporation) (100 parts) were dissolved in monochlorobenzene (630 parts) to prepare a coating solution for a charge transporting layer. The coating solution for a charge transporting layer was applied onto the charge generating layer by immersion coating to form a coating. The coating was dried at 120° C. for 1 hour to dispose a charge transporting layer (hole-transporting layer) having a thickness of 19 μm.

The coatings of the conductive layer, the undercoat layer, the charge generating layer and the charge transporting layer were subjected to heat treatment with an oven set to the respective temperatures. The same procedure is used in the following examples.

The cylindrical (drum-shaped) electrophotographic photosensitive member in Example 2-1 was prepared as above.

Example 2-2

An electrophotographic photosensitive member in Example 2-2 was prepared in the same manner as in Example 2-1 except that preparation of the coating solution for a charge generating layer in Example 2-1 was changed as follows.

The hydroxygallium phthalocyanine crystal prepared in Example 1-2 (charge generating substance) (20 parts), Exemplary compound (7) (0.001 parts), Exemplary resin (1) (10 parts) and cyclohexanone (519 parts) were placed in a sand mill containing glass beads having a diameter of 1 mm, and were dispersed for 4 hours. Subsequently, ethyl acetate (764 parts) was added to prepare a coating solution for a charge generating layer. The coating solution for a charge generating layer was applied onto the undercoat layer by immersion coating to form a coating. The coating was dried at 100° C. for 10 minutes to dispose a charge generating layer having a thickness of 0.18 μm.

Example 2-3

An electrophotographic photosensitive member in Example 2-3 was prepared in the same manner as in Example 2-2 except that the amount of Exemplary compound (7) (0.001 parts) used in preparation of the coating solution for a charge generating layer in Example 2-2 was changed to 0.004 parts.

Example 2-4

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Example 1-3 (charge generating substance) (20 parts). Except that, an electrophotographic photosensitive member in Example 2-4 was prepared in the same manner as in Example 2-1.

Example 2-5

An electrophotographic photosensitive member in Example 2-5 was prepared in the same manner as in Example 2-1 except that preparation of the coating solution for a charge generating layer in Example 2-1 was changed as follows.

The hydroxygallium phthalocyanine crystal prepared in Example 1-1 (charge generating substance) (20 parts), Exemplary compound (7) (0.89 parts), Exemplary resin (1) (10 parts) and cyclohexanone (519 parts) were placed in a sand mill containing glass beads having a diameter of 1 mm, and were dispersed for 4 hours. Subsequently, ethyl acetate (764 parts) was added to prepare a coating solution for a charge generating layer. The coating solution for a charge generating layer was applied onto the undercoat layer by immersion coating to form a coating. The coating was dried at 100° C. for 10 minutes to dispose a charge generating layer having a thickness of 0.18 μm.

Example 2-6

An electrophotographic photosensitive member in Example 2-6 was prepared in the same manner as in Example 2-5 except that the amount of Exemplary compound (7) (0.89 parts) used in preparation of the coating solution for a charge generating layer in Example 2-5 was changed to 1.89 parts.

Example 2-7

An electrophotographic photosensitive member in Example 2-7 was prepared in the same manner as in Example 2-5 except that the amount of Exemplary compound (7) (0.89 parts) used in preparation of the coating solution for a charge generating layer in Example 2-5 was changed to 5.89 parts.

Example 2-8

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Example 1-4 (charge generating substance) (20 parts). Except that, an electrophotographic photosensitive member in Example 2-8 was prepared in the same manner as in Example 2-1.

Example 2-9

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Example 1-5 (charge generating substance) (20 parts). Except that, an electrophotographic photosensitive member in Example 2-9 was prepared in the same manner as in Example 2-1.

Example 2-10

An electrophotographic photosensitive member in Example 2-10 was prepared in the same manner as in Example 2-1 except that preparation of the coating solution for a charge generating layer in Example 2-1 was changed as follows.

The hydroxygallium phthalocyanine crystal prepared in Example 1-2 (charge generating substance) (20 parts), Exemplary compound (26) (production code: M1624, manufactured by Tokyo Chemical Industry Co., Ltd.) (0.2 parts), Exemplary resin (1) (10 parts) and cyclohexanone (519 parts) were placed in a sand mill containing glass beads having a diameter of 1 mm, and were dispersed for 4 hours. Subsequently, ethyl acetate (764 parts) was added to prepare a coating solution for a charge generating layer. The coating solution for a charge generating layer was applied onto the undercoat layer by immersion coating to form a coating. The coating was dried at 100° C. for 10 minutes to dispose a charge generating layer having a thickness of 0.18 μm.

Example 2-11

An electrophotographic photosensitive member in Example 2-11 was prepared in the same manner as in Example 2-10 except that Exemplary resin (1) (10 parts) used in preparation of the coating solution for a charge generating layer in Example 2-10 was replaced by Exemplary resin (12) (10 parts).

Example 2-12

An electrophotographic photosensitive member in Example 2-12 was prepared in the same manner as in Example 2-10 except that Exemplary resin (1) (10 parts) used in preparation of the coating solution for a charge generating layer in Example 2-10 was replaced by Exemplary resin (11) (10 parts).

Example 2-13

An electrophotographic photosensitive member in Example 2-13 was prepared in the same manner as in Example 2-10 except that Exemplary resin (1) (10 parts) used in preparation of the coating solution for a charge generating layer in Example 2-10 was replaced by Exemplary resin (6) (10 parts).

Example 2-14

An electrophotographic photosensitive member in Example 2-14 was prepared in the same manner as in Example 2-10 except that Exemplary resin (1) (10 parts) used in preparation of the coating solution for a charge generating layer in Example 2-10 was replaced by Exemplary resin (7) (10 parts).

Example 2-15

Exemplary compound (26) (0.2 parts) used in preparation of the coating solution for a charge generating layer in Example 2-10 was replaced by Exemplary compound (38) (production code: B3930, manufactured by Tokyo Chemical Industry Co., Ltd.) (0.2 parts). Except that, an electrophotographic photosensitive member in Example 2-15 was prepared in the same manner as in Example 2-10.

Example 2-16

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Example 1-6 (charge generating substance) (20 parts). Except that, an electrophotographic photosensitive member in Example 2-16 was prepared in the same manner as in Example 2-1.

Example 2-17

Exemplary compound (26) (0.2 parts) used in preparation of the coating solution for a charge generating layer in Example 2-10 was replaced by Exemplary compound (75) (production code: M0561, manufactured by Tokyo Chemical Industry Co., Ltd.) (0.2 parts). Except that, an electrophotographic photosensitive member in Example 2-17 was prepared in the same manner as in Example 2-10.

Example 2-18

Exemplary compound (26) (0.001 parts) used in preparation of the coating solution for a charge generating layer in Example 2-10 was replaced by Exemplary compound (4) (production code: A0756, manufactured by Tokyo Chemical Industry Co., Ltd.) (0.2 parts). Except that, an electrophotographic photosensitive member in Example 2-18 was prepared in the same manner as in Example 2-10.

Example 2-19

Exemplary compound (26) (0.2 parts) used in preparation of the coating solution for a charge generating layer in Example 2-10 was replaced by Exemplary compound (24) (production code: D2635, manufactured by Tokyo Chemical Industry Co., Ltd.) (0.2 parts). Except that, an electrophotographic photosensitive member in Example 2-19 was prepared in the same manner as in Example 2-10.

Example 2-20

Exemplary compound (26) (0.2 parts) used in preparation of the coating solution for a charge generating layer in Example 2-10 was replaced by Exemplary compound (51) (production code: H0360, manufactured by Tokyo Chemical Industry Co., Ltd.) (0.2 parts). Except that, an electrophotographic photosensitive member in Example 2-20 was prepared in the same manner as in Example 2-10.

Example 2-21

Exemplary compound (26) (0.2 parts) used in preparation of the coating solution for a charge generating layer in Example 2-10 was replaced by Exemplary compound (69) (production code: A1398, manufactured by Tokyo Chemical Industry Co., Ltd.) (0.2 parts), and Exemplary resin (1) (10 parts) was replaced by Exemplary resin (9) (10 parts). Except that, an electrophotographic photosensitive member in Example 2-21 was prepared in the same manner as in Example 2-10.

Example 2-22

Exemplary compound (69) (0.2 parts) used in preparation of the coating solution for a charge generating layer in Example 2-21 was replaced by Exemplary compound (76) (production code: D1391, manufactured by Tokyo Chemical Industry Co., Ltd.) (0.2 parts). Except that, an electrophotographic photosensitive member in Example 2-22 was prepared in the same manner as in Example 2-21.

Example 2-23

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Example 1-7 (charge generating substance) (20 parts). Except that, an electrophotographic photosensitive member in Example 2-23 was prepared in the same manner as in Example 2-1.

Example 2-24

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Example 1-8 (charge generating substance) (20 parts). Exemplary resin (1) (10 parts) was replaced by Exemplary resin (9) (10 parts). Except these, an electrophotographic photosensitive member in Example 2-24 was prepared in the same manner as in Example 2-1.

Example 2-25

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Example 1-9 (charge generating substance) (20 parts). Exemplary resin (1) (10 parts) was replaced by Exemplary resin (2) (10 parts). Except these, an electrophotographic photosensitive member in Example 2-25 was prepared in the same manner as in Example 2-1.

Example 2-26

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Example 1-10 (charge generating substance) (20 parts). Exemplary resin (1) (10 parts) was replaced by Exemplary resin (8) (10 parts). Except these, an electrophotographic photosensitive member in Example 2-26 was prepared in the same manner as in Example 2-1.

Example 2-27

Exemplary compound (26) (0.2 parts) used in preparation of the coating solution for a charge generating layer in Example 2-10 was replaced by Exemplary compound (54) (production code: B2252, manufactured by Tokyo Chemical Industry Co., Ltd.) (0.2 parts) and Exemplary resin (1) (10 parts) was replaced by Exemplary resin (13) (10 parts). Except these, an electrophotographic photosensitive member in Example 2-27 was prepared in the same manner as in Example 2-10.

Example 2-28

An electrophotographic photosensitive member in Example 2-28 was prepared in the same manner as in Example 2-1 except that preparation of the coating solution for a charge generating layer in Example 2-1 was changed as follows.

The chlorogallium phthalocyanine pigment prepared in Synthesis Example 2 (charge generating substance) (20 parts), Exemplary compound (57) (production code: E0732, manufactured by Tokyo Chemical Industry Co., Ltd.) (0.2 parts), Exemplary resin (1) (10 parts) and cyclohexanone (519 parts) were placed in a sand mill containing glass beads having a diameter of 1 mm, and were dispersed for 4 hours. Subsequently, ethyl acetate (764 parts) was added to prepare a coating solution for a charge generating layer. The coating solution for a charge generating layer was applied onto the undercoat layer by immersion coating to form a coating. The coating was dried at 100° C. for 10 minutes to dispose a charge generating layer having a thickness of 0.27 μm.

Example 2-29

Exemplary compound (57) (0.2 parts) used in preparation of the coating solution for a charge generating layer in Example 2-28 was replaced by Exemplary compound (7) (0.2 parts) and Exemplary resin (1) (10 parts) was replaced by Exemplary resin (6) (10 parts). Except these, an electrophotographic photosensitive member in Example 2-29 was prepared in the same manner as in Example 2-28.

Example 2-30

Exemplary compound (26) (0.2 parts) used in preparation of the coating solution for a charge generating layer in Example 2-10 was replaced by Exemplary compound (85) (production code: C1231, manufactured by Tokyo Chemical Industry Co., Ltd.) (0.2 parts). Except that, an electrophotographic photosensitive member in Example 2-30 was prepared in the same manner as in Example 2-10.

Example 2-31

Exemplary compound (26) (0.2 parts) used in preparation of the coating solution for a charge generating layer in Example 2-10 was replaced by Exemplary compound (163) (production code: B2805, manufactured by Tokyo Chemical Industry Co., Ltd.) (0.2 parts). Except that, an electrophotographic photosensitive member in Example 2-31 was prepared in the same manner as in Example 2-10.

Example 2-32

Exemplary compound (26) (0.2 parts) used in preparation of the coating solution for a charge generating layer in Example 2-10 was replaced by Exemplary compound (100) (production code: N0584, manufactured by Tokyo Chemical Industry Co., Ltd.) (0.2 parts). Except that, an electrophotographic photosensitive member in Example 2-32 was prepared in the same manner as in Example 2-10.

Example 2-33

Exemplary compound (26) (0.2 parts) used in preparation of the coating solution for a charge generating layer in Example 2-10 was replaced by Exemplary compound (5) (production code: C1040, manufactured by Tokyo Chemical Industry Co., Ltd.) (0.2 parts). Except that, an electrophotographic photosensitive member in Example 2-33 was prepared in the same manner as in Example 2-10.

Example 2-34

Exemplary compound (69) (0.2 parts) used in preparation of the coating solution for a charge generating layer in Example 2-21 was replaced by Exemplary compound (53) (production code: P1513, manufactured by Tokyo Chemical Industry Co., Ltd.) (0.2 parts). Except that, an electrophotographic photosensitive member in Example 2-34 was prepared in the same manner as in Example 2-21.

Example 2-35

Exemplary compound (26) (0.2 parts) used in preparation of the coating solution for a charge generating layer in Example 2-10 was replaced by Exemplary compound (117) (production code: P2030, manufactured by Tokyo Chemical Industry Co., Ltd.) (0.2 parts). Except that, an electrophotographic photosensitive member in Example 2-35 was prepared in the same manner as in Example 2-10.

Example 2-36

Exemplary compound (26) (0.2 parts) used in preparation of the coating solution for a charge generating layer in Example 2-10 was replaced by Exemplary compound (131) (production code: C1646, manufactured by Tokyo Chemical Industry Co., Ltd.) (0.2 parts). Except that, an electrophotographic photosensitive member in Example 2-36 was prepared in the same manner as in Example 2-10.

Example 2-37

Exemplary compound (26) (0.2 parts) used in preparation of the coating solution for a charge generating layer in Example 2-10 was replaced by Exemplary compound (141) (production code: M0686, manufactured by Tokyo Chemical Industry Co., Ltd.) (0.2 parts). Except that, an electrophotographic photosensitive member in Example 2-37 was prepared in the same manner as in Example 2-10.

Example 2-38

Exemplary compound (26) (0.2 parts) used in preparation of the coating solution for a charge generating layer in Example 2-10 was replaced by Exemplary compound (138) (production code: B1339, manufactured by Tokyo Chemical Industry Co., Ltd.) (0.2 parts). Except that, an electrophotographic photosensitive member in Example 2-38 was prepared in the same manner as in Example 2-10.

Comparative Example 2-1

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Example 1-2 (charge generating substance) (20 parts). Exemplary resin (1) (10 parts) was replaced by polyvinyl butyral (trade name: S-LEC BX-1, manufactured by Sekisui Chemical Co., Ltd.) (10 parts). Except these, an electrophotographic photosensitive member in Comparative Example 2-1 was prepared in the same manner as in Example 2-1.

Comparative Example 2-2

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Example 1-2 (charge generating substance) (20 parts). Except that, an electrophotographic photosensitive member in Comparative Example 2-2 was prepared in the same manner as in Example 2-1.

Comparative Example 2-3

Exemplary resin (1) (10 parts) used in preparation of the coating solution for a charge generating layer in Example 2-1 was replaced by polyvinyl butyral (trade name: S-LEC BX-1, manufactured by Sekisui Chemical Co., Ltd.) (10 parts). Except that, an electrophotographic photosensitive member in Comparative Example 2-3 was prepared in the same manner as in Example 2-1.

Comparative Example 2-4

The hydroxygallium phthalocyanine crystal prepared in Example 1-1 (charge generating substance) (20 parts) used in preparation of the coating solution for a charge generating layer in Example 2-1 was replaced by the hydroxygallium phthalocyanine crystal prepared in Comparative Example 1-1 (charge generating substance) (20 parts). Except that, an electrophotographic photosensitive member in Comparative Example 2-4 was prepared in the same manner as in Example 2-1.

Comparative Example 2-5

An electrophotographic photosensitive member in Comparative Example 2-5 was prepared in the same manner as in Example 2-1 except that preparation of the coating solution for a charge generating layer in Example 2-1 was changed as follows.

A bisazo pigment represented by Formula (10) (20 parts), Exemplary compound (7) (0.2 parts), Exemplary resin (1) (8 parts) and cyclohexanone (380 parts) were placed in a sand mill containing glass beads having a diameter of 0.8 mm, and were dispersed for 20 hours. Subsequently, ethyl acetate (640 parts) was added to prepare a coating solution for a charge generating layer. The coating solution for a charge generating layer was applied onto the undercoat layer by immersion coating to form a coating. The coating was dried at 80° C. for 10 minutes to dispose a charge generating layer having a thickness of 0.28 μm.

Formula (10)

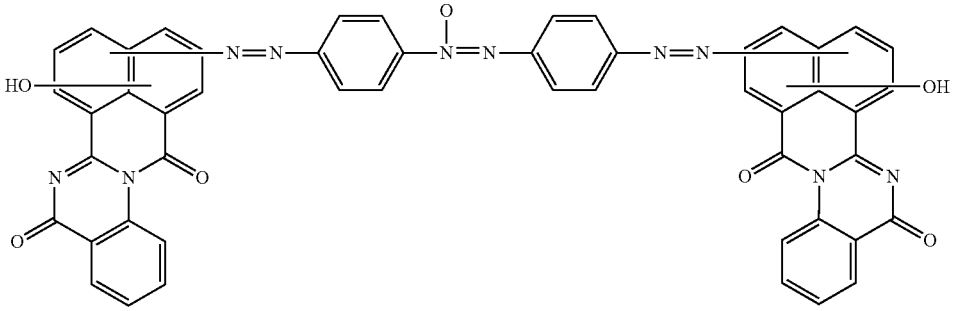

[Evaluation of Examples 2-1 to 2-38 and Comparative Examples 2-1 to 2-5]

The electrophotographic photosensitive members in Examples 2-1 to 2-38 and Comparative Examples 2-1 to 2-5 were evaluated for ghost under a normal temperature and normal humidity environment at 23° C./50% RH and under a low temperature and low humidity environment at 15° C./10% RH.

A modified laser beam printer manufactured by Hewlett-Packard Company (trade name: Color Laser Jet CP3525dn) was used as an electrophotographic apparatus for evaluation. The laser beam printer was modified not to turn on pre-exposing light and to operate such that charging conditions and the laser exposure amount were variable. The laser beam printer was also modified to operate in the state where each of the electrophotographic photosensitive members prepared above was mounted on a process cartridge for cyan and the process cartridge was mounted on the station for the cyan process cartridge, and the process cartridges for other colors were not mounted on the main body of the laser beam printer.

In output of an image, only the cyan process cartridge was mounted on the main body of the laser beam printer or a copier to output a monochrome image formed with only a cyan toner.

The surface potential of the electrophotographic photosensitive member was set such that the initial dark potential was −500 V, and the bright potential was −150 V. In measurement of the surface potential of the electrophotographic photosensitive member for setting the potential, a potential probe (trade name: Model 6000B-8, manufactured by Trek Japan, Co., Ltd.) was mounted on the developing position of the process cartridge. Via the mounted potential probe, the potential of the center in the longitudinal direction of the electrophotographic photosensitive member was measured with a surface electrometer (trade name: Model 344, manufactured by Trek Japan, Co., Ltd.).

First, ghost was evaluated under a normal temperature and normal humidity environment at 23° C./50% RH. Subsequently, a sheet feeding durability (repeated use) test was performed under the same environment using 1,000 sheets to evaluate ghost immediately after the durability test. The results of evaluation under the normal temperature and normal humidity environment are shown in Table 1.

Next, the electrophotographic photosensitive member and the electrophotographic apparatus for evaluation were left under a low temperature and low humidity environment at 15° C./10% RH for 3 days, and ghost was evaluated. A sheet feeding durability test was performed under the same environment using 1,000 sheets to evaluate ghost immediately after the durability test. The results of evaluation under the low temperature and low humidity environment are shown in Table 1.

In the sheet feeding durability test, an image of an alphabet letter E at a coverage rate of 1% was formed on an A4 size normal paper with only a cyan toner.

The evaluation was made on the following criteria.

Figure 5:
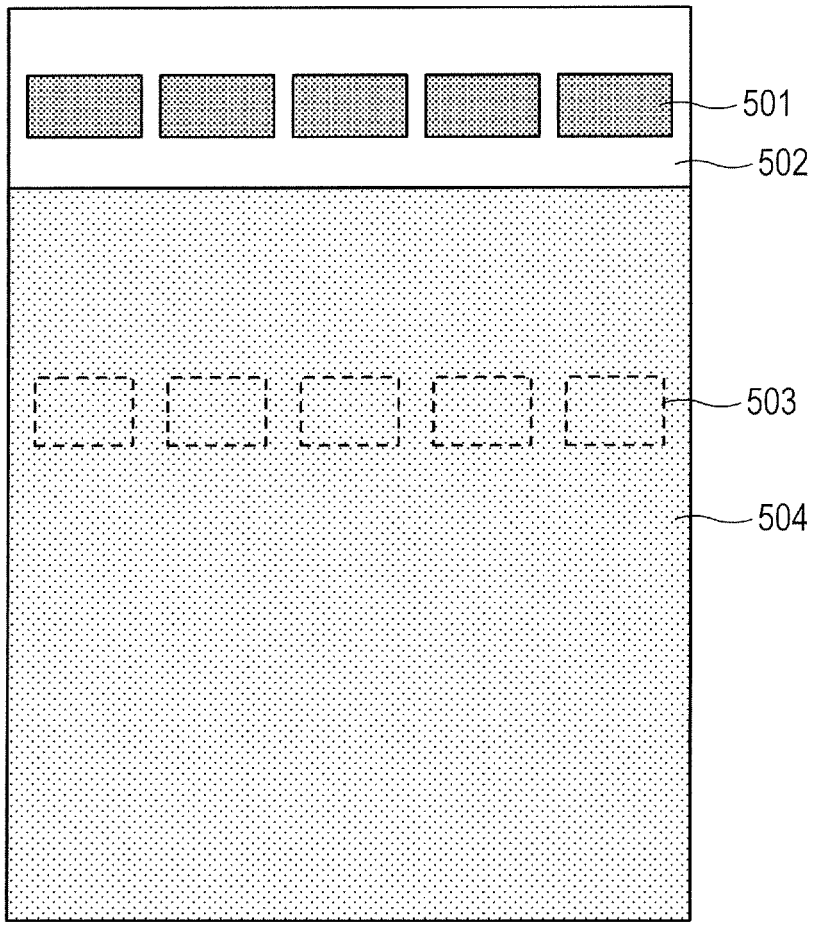
FIG. 5 is a drawing illustrating an image for evaluation of ghost.

An image for evaluation of ghost was formed by outputting a rectangular image of a solid black 501 in the leading portion of the image, and outputting a halftone image 504 of one dot KEIMA pattern, as illustrated in FIG. 5. In FIG. 5, a white portion 502 (white image) and a portion 503 where ghost appears are illustrated. First, a solid white image was output on a first sheet. Subsequently, the image for evaluation of ghost was continuously output on 5 sheets. Next, a solid black image was output on one sheet, and the image for evaluation of ghost was output on 5 sheets again. The images were output in this order and manner, and the images for evaluation of ghost formed on 10 sheets in total were evaluated.

Evaluation of ghost was performed by measuring the image density of the one dot KEIMA pattern image and the image density of the ghost portion (portion where ghost could appear) with a spectrodensitometer (trade name: X-Rite 504/508, available form X-Rite, Incorporated) and determining the difference in the image density. The image density was measured at 10 places of the image for evaluation of ghost formed on one sheet, and the average of the 10 image densities was defined as the result for one sheet. The images for evaluation of ghost formed on the 10 sheets were measured in the same manner as above. The average value was determined, and was defined as the difference in the image density in each of Examples. A smaller difference in the image density indicates that the degree of ghost is smaller and better. In Table 1, "Initial" refers to the difference in the image density before the sheet feeding durability test using 1,000 sheets is performed under a normal temperature and normal humidity environment or under a low temperature and low humidity environment, and "After durability test" refers to the difference in the image density after the sheet feeding durability test using 1,000 sheets is performed under a normal temperature and normal humidity environment or under a low temperature and low humidity environment.

TABLE 1

| | Difference in image density | | | |
|---|---|---|---|---|
| | Under normal temperature and normal humidity environment | | Under low temperature and low humidity environment | |
| | Initial | After durability test | Initial | After durability test |
| Example 2-1 | 0.019 | 0.021 | 0.020 | 0.022 |
| Example 2-2 | 0.023 | 0.030 | 0.028 | 0.031 |
| Example 2-3 | 0.025 | 0.027 | 0.024 | 0.028 |
| Example 2-4 | 0.017 | 0.020 | 0.022 | 0.025 |
| Example 2-5 | 0.018 | 0.023 | 0.018 | 0.025 |
| Example 2-6 | 0.022 | 0.024 | 0.021 | 0.024 |
| Example 2-7 | 0.022 | 0.025 | 0.022 | 0.026 |
| Example 2-8 | 0.020 | 0.025 | 0.022 | 0.028 |
| Example 2-9 | 0.022 | 0.022 | 0.022 | 0.025 |
| Example 2-10 | 0.023 | 0.027 | 0.026 | 0.025 |
| Example 2-11 | 0.026 | 0.031 | 0.028 | 0.037 |
| Example 2-12 | 0.023 | 0.033 | 0.024 | 0.036 |
| Example 2-13 | 0.027 | 0.032 | 0.027 | 0.035 |
| Example 2-14 | 0.027 | 0.031 | 0.026 | 0.035 |
| Example 2-15 | 0.022 | 0.027 | 0.022 | 0.028 |
| Example 2-16 | 0.019 | 0.020 | 0.022 | 0.022 |
| Example 2-17 | 0.020 | 0.023 | 0.020 | 0.028 |
| Example 2-18 | 0.021 | 0.024 | 0.025 | 0.027 |
| Example 2-19 | 0.022 | 0.027 | 0.027 | 0.026 |
| Example 2-20 | 0.025 | 0.028 | 0.025 | 0.030 |
| Example 2-21 | 0.024 | 0.024 | 0.023 | 0.029 |
| Example 2-22 | 0.023 | 0.028 | 0.024 | 0.029 |
| Example 2-23 | 0.019 | 0.023 | 0.023 | 0.026 |
| Example 2-24 | 0.020 | 0.022 | 0.022 | 0.022 |
| Example 2-25 | 0.021 | 0.031 | 0.020 | 0.032 |
| Example 2-26 | 0.023 | 0.030 | 0.021 | 0.029 |
| Example 2-27 | 0.030 | 0.035 | 0.029 | 0.037 |
| Example 2-28 | 0.028 | 0.034 | 0.037 | 0.037 |
| Example 2-29 | 0.025 | 0.035 | 0.030 | 0.039 |
| Example 2-30 | 0.025 | 0.026 | 0.026 | 0.030 |
| Example 2-31 | 0.029 | 0.029 | 0.026 | 0.029 |
| Example 2-32 | 0.024 | 0.030 | 0.028 | 0.031 |
| Example 2-33 | 0.024 | 0.026 | 0.028 | 0.030 |
| Example 2-34 | 0.027 | 0.033 | 0.031 | 0.031 |
| Example 2-35 | 0.031 | 0.029 | 0.028 | 0.036 |
| Example 2-36 | 0.029 | 0.035 | 0.030 | 0.038 |
| Example 2-37 | 0.026 | 0.030 | 0.033 | 0.032 |
| Example 2-38 | 0.030 | 0.033 | 0.031 | 0.035 |
| Comparative Example 2-1 | 0.047 | 0.071 | 0.052 | 0.136 |
| Comparative Example 2-2 | 0.038 | 0.052 | 0.045 | 0.103 |
| Comparative Example 2-3 | 0.037 | 0.059 | 0.046 | 0.109 |
| Comparative Example 2-4 | 0.036 | 0.053 | 0.040 | 0.084 |
| Comparative Example 2-5 | 0.037 | 0.049 | 0.047 | 0.114 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-204613, filed Sep. 30, 2013, which is hereby incorporated by reference herein in its entirety.

What is claimed is:

1. An electrophotographic photosensitive member, comprising:

a support;

a charge generating layer on the support; and a charge transporting layer on the charge generating layer, wherein the charge generating layer comprises:

a gallium phthalocyanine crystal;

a nitrogen-containing heterocyclic compound; and a resin having a structural unit represented by Formula (1):

Formula (1)

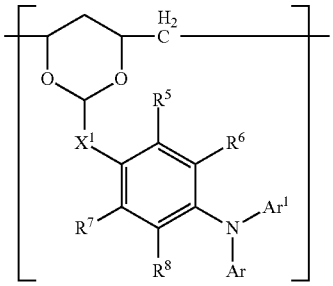

wherein, $X^1$ represents a substituted or unsubstituted ethylene group, a substituted or unsubstituted propylene group, or a substituted or unsubstituted butylene group;

$R^5$, $R^6$, $R^7$ and $R^8$ each independently represent a hydrogen atom, a saturated hydrocarbon group or a methoxy group; and $Ar^1$ and $Ar^2$ each independently represent a phenyl group having one or more electron-donating substituents, and wherein a nitrogen atom in a heterocyclic ring of the nitrogen-containing heterocyclic compound has a substituent, wherein the substituent is a substituted or unsubstituted acyl group, —(C═O)—O—$R^1$, a substituted or unsubstituted alkyl group, a substituted or unsubstituted alkenyl group, a substituted or unsubstituted aryl group, or a substituted or unsubstituted heterocyclic group, wherein a substituent of the substituted acyl group is a substituted or unsubstituted alkyl group, a substituted or unsubstituted alkenyl group, a substituted or unsubstituted aryl group, or a substituted or unsubstituted heterocyclic group; $R^1$ represents a substituted or unsubstituted alkyl group, a substituted or unsubstituted alkenyl group, a substituted or unsubstituted aryl group, or a substituted or unsubstituted heterocyclic group; and a substituent of the substituted alkyl group, a substituent of the substituted alkenyl group, a substituent of the substituted aryl group and a substituent of the substituted heterocyclic group are a halogen atom, a cyano group, a nitro group, a hydroxy group, a formyl group, an alkyl group, an alkenyl group, an alkoxy group or an aryl group.

2. The electrophotographic photosensitive member according to claim 1, wherein the nitrogen-containing heterocyclic compound is pyrrole, pyrrolidine, morpholine, piperazine, piperidine, 4-piperidone, indole, phenothiazine, phenoxazine or carbazole.

3. The electrophotographic photosensitive member according to claim 1, wherein the substituent bonding to an atom other than the nitrogen atom that forms the ring of the nitrogen-containing heterocyclic compound is a hydrogen atom, a substituted or unsubstituted alkyl group, a substituted or unsubstituted aryl group, a substituted or unsubstituted heterocyclic group, a halogen atom, a hydroxy group, a formyl group, an alkenyl group, an alkoxy group or an alkyloxycarbonyl group, wherein a substituent of the substituted alkyl group, a substituent of the substituted aryl group and a substituent of the substituted heterocyclic group are a halogen atom, a hydroxy group or a formyl group.

4. The electrophotographic photosensitive member according to claim 1, wherein the nitrogen-containing heterocyclic compound is a compound represented by Formula (2):

Formula (2)

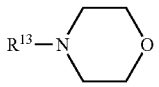

wherein $R^{13}$ represents a substituted or unsubstituted acyl group, —(C═O)—O—$R^{11}$, a substituted or unsubstituted alkyl group, a substituted or unsubstituted alkenyl group, a substituted or unsubstituted aryl group or a substituted or unsubstituted heterocyclic group; a substituent of the substituted acyl group is a substituted or unsubstituted alkyl group, a substituted or unsubstituted alkenyl group, a substituted or unsubstituted aryl group, or a substituted or unsubstituted heterocyclic group; $R^{11}$ represents a substituted or unsubstituted alkyl group, a substituted or unsubstituted alkenyl group, a substituted or unsubstituted aryl group, or a substituted or unsubstituted heterocyclic group;

wherein a substituent of the substituted alkyl group, a substituent of the substituted alkenyl group, a substituent of the substituted aryl group and a substituent of the substituted heterocyclic group are a halogen atom, a cyano group, a nitro group, a hydroxy group, a formyl group, an alkyl group, an alkenyl group, an alkoxy group or an aryl group.

5. The electrophotographic photosensitive member according to claim 4, wherein $R^{13}$ in Formula (2) is a methyl group, an ethyl group or a phenyl group.

6. The electrophotographic photosensitive member according to claim 1, wherein the nitrogen-containing heterocyclic compound is a compound represented by Formula (3):

Formula (3)

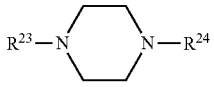

wherein $R^{23}$ and $R^{24}$ each independently represent a substituted or unsubstituted acyl group, —(C═O)—O—$R^{21}$, a substituted or unsubstituted alkyl group, a substituted or unsubstituted alkenyl group, a substituted or unsubstituted aryl group or a substituted or unsubstituted heterocyclic group; a substituent of the substituted acyl group is a substituted or unsubstituted alkyl group, a substituted or unsubstituted alkenyl group, a substituted or unsubstituted aryl group or a substituted or unsubstituted heterocyclic group; $R^{21}$ represents a substituted or unsubstituted alkyl group, a substituted or unsubstituted alkenyl group, a substituted or unsubstituted aryl group or a substituted or unsubstituted heterocyclic group;

wherein a substituent of the substituted alkyl group, a substituent of the substituted alkenyl group, a substituent of the substituted aryl group and a substituent of the substituted heterocyclic group are a halogen atom, a cyano group, a nitro group, a hydroxy group, a formyl group, an alkyl group, an alkenyl group, an alkoxy group or an aryl group.

7. The electrophotographic photosensitive member according to claim 6, wherein $R^{23}$ and $R^{24}$ in Formula (3) are each independently a methyl group, an ethyl group or a phenyl group.

8. The electrophotographic photosensitive member according to claim 1, wherein the nitrogen-containing heterocyclic compound is a compound represented by Formula (4):

Formula (4)

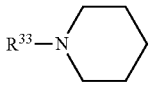

wherein $R^{33}$ represents a substituted or unsubstituted acyl group, —(C═O)—O—$R^{31}$, a substituted or unsubstituted alkyl group, a substituted or unsubstituted alkenyl group, a substituted or unsubstituted aryl group or a substituted or unsubstituted heterocyclic group; a substituent of the substituted acyl group is a substituted or unsubstituted alkyl group, a substituted or unsubstituted alkenyl group, a substituted or unsubstituted aryl group or a substituted or unsubstituted heterocyclic group; $R^{31}$ represents a substituted or unsubstituted alkyl group, a substituted or unsubstituted alkenyl group, a substituted or unsubstituted aryl group or a substituted or unsubstituted heterocyclic group;

wherein a substituent of the substituted alkyl group, a substituent of the substituted alkenyl group, a substituent of the substituted aryl group and a substituent of the substituted heterocyclic group are a halogen atom, a cyano group, a nitro group, a hydroxy group, a formyl group, an alkyl group, an alkenyl group, an alkoxy group or an aryl group.

9. The electrophotographic photosensitive member according to claim 8, wherein $R^{33}$ in Formula (4) is a methyl group, an ethyl group or a phenyl group.

10. The electrophotographic photosensitive member according to claim 1, wherein the nitrogen-containing heterocyclic compound is a compound represented by Formula (5):

Formula (5)

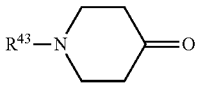

wherein $R^{43}$ represents a substituted or unsubstituted acyl group, —(C═O)—O—$R^{41}$, a substituted or unsubstituted alkyl group, a substituted or unsubstituted alkenyl group, a substituted or unsubstituted aryl group or a substituted or unsubstituted heterocyclic group; a substituent of the substituted acyl group is a substituted or unsubstituted alkyl group, a substituted or unsubstituted alkenyl group, a substituted or unsubstituted aryl group or a substituted or unsubstituted heterocyclic group; $R^{41}$ represents a substituted or unsubstituted alkyl group, a substituted or unsubstituted alkenyl group, a substituted or unsubstituted aryl group or a substituted or unsubstituted heterocyclic group;

wherein a substituent of the substituted alkyl group, a substituent of the substituted alkenyl group, a substituent of the substituted aryl group and a substituent of the substituted heterocyclic group are a halogen atom, a cyano group, a nitro group, a hydroxy group, a formyl group, an alkyl group, an alkenyl group, an alkoxy group or an aryl group.

11. The electrophotographic photosensitive member according to claim 10, wherein $R^{43}$ in Formula (5) is a methyl group, an ethyl group or a phenyl group.

12. The electrophotographic photosensitive member according to claim 1, wherein the nitrogen-containing heterocyclic compound is a compound represented by Formula (6):

Formula (6)

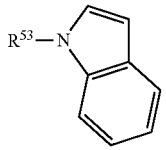

wherein $R^{53}$ represents a substituted or unsubstituted acyl group, —(C═O)—O—$R^{51}$, a substituted or unsubstituted alkyl group, a substituted or unsubstituted alkenyl group, a substituted or unsubstituted aryl group, or a substituted or unsubstituted heterocyclic group; a substituent of the substituted acyl group is a substituted or unsubstituted alkyl group, a substituted or unsubstituted alkenyl group, a substituted or unsubstituted aryl group, or a substituted or unsubstituted heterocyclic group; $R^{51}$ represents a substituted or unsubstituted alkyl group, a substituted or unsubstituted alkenyl group, a substituted or unsubstituted aryl group, or a substituted or unsubstituted heterocyclic group;

wherein a substituent of the substituted alkyl group, a substituent of the substituted alkenyl group, a substituent of the substituted aryl group and a substituent of the substituted heterocyclic group are a halogen atom, a cyano group, a nitro group, a hydroxy group, a formyl group, an alkyl group, an alkenyl group, an alkoxy group, or an aryl group.

13. The electrophotographic photosensitive member according to claim 12, wherein $R^{53}$ in Formula (6) is a methyl group, an ethyl group or a phenyl group.

14. The electrophotographic photosensitive member according to claim 1, wherein a content of the nitrogen-containing heterocyclic compound in the charge generating layer is 0.01% by mass or more and 20% by mass or less based on the gallium phthalocyanine crystal.

15. The electrophotographic photosensitive member according to claim 1, wherein the gallium phthalocyanine crystal is a gallium phthalocyanine crystal in which the nitrogen-containing heterocyclic compound is contained.

16. The electrophotographic photosensitive member according to claim 1, wherein $X^1$ in Formula (1) is an unsubstituted ethylene group.

17. The electrophotographic photosensitive member according to claim 1, wherein an electron-donating substituent in Formula (1) is an alkyl group.

18. The electrophotographic photosensitive member according to claim 1, wherein the gallium phthalocyanine crystal is a hydroxygallium phthalocyanine crystal in a crystal form having peaks at Bragg angles 2θ of 7.4°±0.3° and 28.2°±0.3° in X-ray diffraction with CuKα radiation.

19. A process cartridge detachably mountable on a main body of an electrophotographic apparatus, the process cartridge comprising the electrophotographic photosensitive member according to claim 1 and at least one unit selected from the group consisting of a charging unit, a developing unit, a transferring unit and a cleaning unit, the electrophotographic photosensitive member according to claim 1 and the at least one unit being integrally supported.

20. An electrophotographic apparatus, comprising the electrophotographic photosensitive member according to claim 1, a charging unit, an image exposing unit, a developing unit and a transferring unit.

* * * * *